US006201173B1

(12) United States Patent
Black

(10) Patent No.: US 6,201,173 B1
(45) Date of Patent: Mar. 13, 2001

(54) SYSTEM FOR REMOTELY PLAYING A PERCUSSION MUSICAL INSTRUMENT

(76) Inventor: Jet Black, Culkerson Station, Tetbury, Glou (GB), GL8 8SS ( * ) Notice: Subject to any disclaimer, the term of this patent is extended or adjusted under 35 U.S.C. 154(b) by 0 days.

(21) Appl. No.: 09/000,109

(22) PCT Filed: Jul. 19, 1996

(86) PCT No.: PCT/GB96/01753

§ 371 Date: Jun. 15, 1998

§ 102(e) Date: Jun. 15, 1998

(87) PCT Pub. No.: WO97/04440

PCT Pub. Date: Feb. 6, 1997

(30) Foreign Application Priority Data

Jul. 19, 1995 (GB) ..... 9514829
Feb. 6, 1996 (GB) ..... 9602394

(51) Int. Cl.[7] ..... G10D 13/02

(52) U.S. Cl. ..... 84/422.1; 84/721; 84/746; 84/104

(58) Field of Search ..... 84/721, 746, 104, 84/411 R, 422.1, 422.3, 644, 670

(56) References Cited

U.S. PATENT DOCUMENTS 3,967,523 * 7/1976 Currier et al. ..... 84/422 R
5,028,776 * 7/1991 Forti et al. ..... 250/229
5,438,903 * 8/1995 Cropek ..... 84/422.3
5,453,567 * 9/1995 Brinson ..... 84/104
5,591,929 * 1/1997 Wellman ..... 84/422.1

FOREIGN PATENT DOCUMENTS

WO 94/27279 * 11/1994 (WO) .

* cited by examiner

*Primary Examiner*—Stanley J. Witkowski
*Assistant Examiner*—Marlon T. Fletcher
(74) *Attorney, Agent, or Firm*—Locke Reynolds LLP

(57) ABSTRACT

An arrangement for enabling facile and efficient operation of at least one bass drum mallet, in combination with at least one bass drum, such that the bass drum with its associated mallet can be placed in any desired location, within and beyond, a limited Critical Performance Area which is encountered with conventional drumming equipment, and such that the mallet is operable by means of at least one foot pedal, placed close to, or remote from, the location of the mallet/bass drum assembly. The arrangement offers considerable flexibility in the location of bass drums and other drum/musical instruments, and equipment, and can be operated by means of wire, wireless, or direct mechanical, communication between the foot pedal and the bass drum mallet.

18 Claims, 25 Drawing Sheets

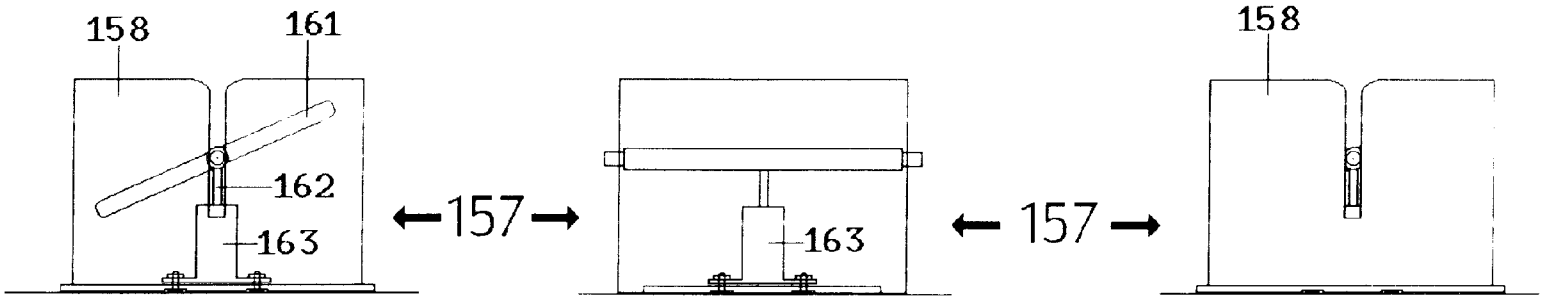
FIGURE 24A
FIGURE 24B
FIGURE 24C
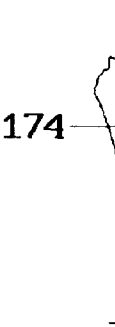
FIGURE 24D
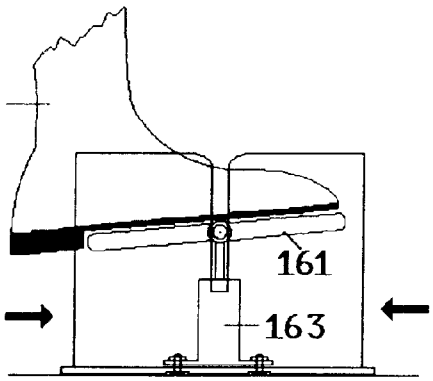
FIGURE 24E
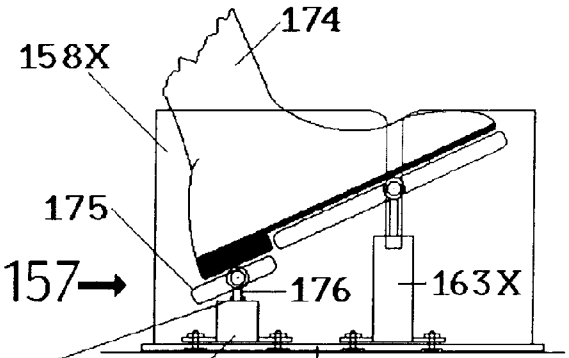
FIGURE 24F

SYSTEM FOR REMOTELY PLAYING A PERCUSSION MUSICAL INSTRUMENT

BACKGROUND OF THE INVENTION

1. Field of the Invention

This invention relates to means for producing a force at the surface of an object in response to human action, and while the concepts of the invention will be shown to be applicable in many areas, the present description concentrates mainly on drums and drumming.

2. Description of Related Art

Many parts of the equipment described in the following text involve use of components and circuitry supplied by RS Components Limited. These are referred to by means of RS Stock Numbers. Also, some of the circuit and other diagrams are either wholly from RS originals or are modified versions of the originals and are reproduced by permission of RS Components Ltd. Where this applies, reference to RS Components is made. Other equipment is similarly described and its source acknowledged. A full Stock Number listing and acknowledgment is made at the end of the text.

The Drum is one of the oldest musical instruments, and is a basic requirement in any music. Drummers put "energy", into playing, and the conventional drum-kit is played using all four limbs to strike at various drums and cymbals in a varied and coordinated series of beats.

The basic drum-kit consists of a medium sized drum, called a snare drum, a tom tom, and a set of cymbals, all of which are played by means of a stick in each hand. Another drum, called a bass drum, is the largest drum and has a loud booming sound. This drum is usually played on its side and is struck with a beater/mallet which is operated by one foot by means of a foot pedal which is attached to the rim of the drum. The other foot brings about the rise and fall of the top cymbal of a pair of cymbals via another foot pedal mechanism in an instrument known as a hi-hat.

In order to play the equipment skillfully, it is necessary for the drummer to be seated, and the area around him that can be reached with the hands and feet while still seated, is known as the Critical Performance Area (CPA).

The very first drum kit was probably no more than a bass drum and a snare drum. Eventually, a small tom-tom was secured to the bass drum, and then two. Gradually, tom-toms became larger and bass drums became smaller.

Since those humble beginnings, the modern professional drum-kit has evolved into a complex variety of equipment which routinely consists of anything up to ten, fifteen and even twenty, drums and cymbals. However, notwithstanding all of the refinements of modern equipment, a persistent complaint of drummers is that they can never become entirely comfortable with the kit because there is a constant need for adjustment and repositioning of equipment, in pursuit of the ideal set-up.

With each new improvement to equipment, however, the drummer has been able to raise the standard of his performance and technique accordingly. This improvement has played an accompanying major role in the development of each musical genre; the very life blood of the entire music industry.

Today's standard drum kit continues to feature one or two tom-toms mounted above the bass drum, but a slow move away from this standard has taken place during the past decade. Thus new drum hardware now allows the bass drum to be released from its secondary role as a mounting for the tom-tom with the result that drummers are beginning to realize that the bass drum, once the focal point of the drum kit, can now be moved away from its traditional location. There are, anyway, three principle reasons why this movement in desirable:

1. Comfort

The traditional orientation of the foot in relation to the body, when operating the bass drum pedal, is straight ahead. This position of the foot is uncomfortable, and most drummers prefer to have the foot up to 45 degrees off center; to the left for a left handed drummer and to the right for a right handed drummer. Under these circumstances, the bass drum can be as much as 15 to 20 inches to the left or right of the traditional location.

2. Technique

The design of the basic bass drum pedal requires the drummer to move the pedal up and down by means of a heel pivotal action with the heel of the foot on the floor. However, most professional drummers find that they cannot achieve the level of control and power they require using this method. The technique usually adopted is to raise the heel completely off the ground and to move the whole leg up and down, actuating the pedal with the ball or with the front part of the sole of the foot or shoe or shoe covering. In order to do this, it is desirable for the bass drum to be closer to the drummer but even when it is closer, there remains a tendency for the foot of the drummer to slide down the contact surface of the pedal.

3. Space

Whether the bass drum is used in the traditional way, with the bass drum directly in front of the drummer, or in the preferred way, with the bass drum to the side of the drummer, there will always be limited space within the CPA for any equipment. In either configuration, with the bass drum in front, or moved to the side, but particularly the latter, a compromise in bass drum and tom-tom size may therefore be necessary. In the traditional set-up, with tom-toms attached to the bass drum, the drummer is constrained because, if he moves the bass drum to the right in order to achieve foot comfort, the tom-toms move with it and will then be in the wrong place.

Happily, because of the greater flexibility in mounting methods, it is now possible to locate tom-toms and indeed all percussion instruments, in almost any conceivable position; however, one unalterable fact is that wherever the bass drum is located, it will occupy space that nothing else can occupy, and being the largest drum, this space is significant.

The position of the bass drum is especially important when the kit contains more than two, bass drum-mounted tom-toms.

In general, therefore, with today's more sophisticated bass drum patterns, the drummer needs to have much tighter control over the position of this vital instrument.

As standards and techniques have evolved, many, once tolerated, inadequacies, have been swept away by the superior refinements achieved by modern manufacturers; but not all; if the bass drum could be removed from the CPA, then a whole new world of drumming possibilities would be created.

Because drummers have different physiques, it would be rare to find two drum-kits set up in exactly the same way. Each drummer will thus set up the equipment within the CPA so as to achieve the most convenient and comfortable operation; the main factors being height, reach, and individual playing style. For right-handed drummers, the bass drum is operated by the right foot (and vice versa); some drummers, are right handed while also being left and right footed (and vice versa) and some are both left, and right, handed and footed. The natural angle at which the foot projects from the body is an important factor in setting up the entire drum-kit.

Since the bass drum has to be located immediately in front of the pedal, and since the pedal has to be located where the foot is, the natural inclination of the foot will govern where the bass drum is located. If a drummer had feet which naturally pointed at an angle of, say, 45 deg., to left and right of center, a bass drum placed directly in front of the drummer would be uncomfortable to play and so would need to located at, or near, that 45 deg. position for comfort. Only when the drummer's feet point straight ahead, is it ideal to place the bass drum directly in front of him.

In summary, therefore, one can say that there have been many excellent advances in the equipment which holds and supports the drums and cymbals, so that it is now possible to locate percussion instruments in almost any conceivable position. However, one unalterable factor is that, wherever the bass drum is located, it will occupy space to the exclusion of other equipment and, being the largest drum, this space is significant. In virtually every, drum-kit configuration, tom-toms are mounted above the bass drum. This means that a compromise between bass drum size, and/or tom-tom size, is usually inevitable because of limitations in space and the necessity for the tom-toms to be placed within the limits of the CPA. Currently, the pedal of the pedal-operated bass drum, is operated via the sole of the foot, with the heel sometimes acting as fulcrum, but some drummers prefer to place the base of the foot on the pedal, with the heel off the ground.

One common foot pedal mechanism involves use of a chain connected to a footplate where the chain acts as a puller, such that the chain, on passing over a toothed wheel on a shaft, operates a mallet which is fixed to the same shaft and which is used to beat against the head of the drum. Return of the mallet to its rest position, when the drummer lifts the foot, is implemented by means of return springs fixed to the mechanism. Various means of adjustment are provided for controlling the force with which the mallet strikes the surface of the drum, thereby catering for the individual needs of the drummer.

However, current equipment does not always suit the basic style adopted by many drummers, who prefer to operate the pedal by moving the whole foot up and down, thus relying on the thigh/leg/foot, operating as an actuation mechanism, with no contact with the ground being made by the foot.

Furthermore, the fundamental principle of operation of current equipment outlined above, dictates that the pedal mechanism be placed directly in front of the bass drum and this, in turn, dictates that the bass drum be placed within reach of the foot. Consequently, the drummer is constrained to place the other drum equipment in certain locations.

Drummers who tend to want to place their feet so that they are not parallel with one another but are inclined at various angles, cannot achieve this without placing one bass drum or two bass drums, or one bass drum and one hi-hat, in locations which dictate that other equipment has to be placed in particular locations. There is also a tendency for the foot to slide down the operating plate of the pedal, especially when using a drumming style involving up and down movement of the thigh/leg/foot, with the heel off the ground.

Another feature of present equipment is that the amount of power which can be delivered by the drummer is limited by the characteristics of the mechanism and driven mallet, and by the strength of the drummer.

It is an object of the present invention to at least overcome these limitations and to introduce new methods of operating bass drums per se.

BRIEF SUMMARY OF THE INVENTION

According to the present invention, a force is applied to the surface of an object in response to human action which is assisted by power derived from an electrical supply. Conventional means for operating the striking parts of, for example, a piano or of a bell or of a bass drum, are therefore replaced by power assisted means.

In application to bass drums, the conventional pedal mechanism used for operating a bass drum, is replaced by one based on the use of electromagnetic or other methods, for operating the mallet. By these means, it is possible to place the pedal mechanism(s) in any location(s) which suit(s) the drummer. Furthermore, such use of electromagnetism allows the mallet to be driven either via direct electrical wire linkages or by means of a radio or other remote link; both based on the transmission and reception of electromagnetic radiation, which does not depend on direct wiring. The latter alternative lends itself to many other possibilities offering greater flexibility in use of drum equipment and other musical equipment.

There is also an accompanying facility for different styles of foot pedal mechanism to be used in conjunction with the new mallet operating equipment and to suit the specific requirements of drummers.

As an alternative to electromagnetic methods, it is also possible to achieve the goal of flexible operation of the mallet or mallets, by use of flexible wire or cord linkages or flexible pneumatic or hydraulic linkages, which transfer the force applied by the drummer at the foot pedal, to the mallet driving mechanism, at the bass drum.

However, the ultimate degree of flexibility will be achieved via a wireless link between the drummer and the driven mallet. This will be possible by using radio control methods similar to those currently used with controlling mechanisms associated with air, land, and sea, based, vehicles and robots, operated remotely.

The fundamental principle exhibited in any system involving conversion of a mechanical force into an electrical signal, is transduction. Thus, for instance, it would be possible to arrange for movement of the foot of the drummer to either generate electricity or to cause a change in electrical resistance or other electrical property, in an electronic circuit. The ultimate aim is to drive electrically operated equipment which moves the drum-beating mallet, towards and away from, the sound producing surface of the bass drum, in unison with the movement of the foot of the drummer or of any other part or parts of his body which actuates the transducing device or mechanism.

Two basic methods are available for creating the sound resulting from the impact of the head of the mallet with the sound producing surface of the drum:

1. Linear motion of the mallet towards, and away from, the Drum surf ace.
2. Rotational motion of the mallet towards, and away from, the Drum surface.

In either method, ideally, it will be necessary for the change in the position of the mallet, to correspond with the change in the position of the drummer's foot or of any other part or parts of his body.

Linear methods for operating the mallet are not known in current equipment and may not exist, for a variety of reasons. One explanation might be that the linear mechanism does not lend itself to easy implementation and facile adjustment, in existing equipment. However, observations on this variant are made later with reference to specific variants of the invention.

With reference to the linear method, it is possible for a solenoid connected to a suitably designed mallet, to be used for allowing the action of the foot or other part or parts, of the body of the drummer, to operate the mallet. However, a simple switch closure would result in uncontrolled movement of the solenoid-mallet, towards the drum head, with no provision for feedback response being supplied to the drummer. Also, the power of the stroke of the solenoid shaft needs to be under control, in order to avoid damage to the drum head and to allow the drummer to vary the power, intensity, frequency and timbre, of the drum beat.

To a certain extent, this can be limited by choice of solenoid, and a spring damper could be used to control the force with which the mallet head strikes the drum head. Similar reasoning will apply to the use of a rotational solenoid, although this method of driving the mallet does have some similarities with conventional methods.

Both of the above mentioned devices are available from RS Components under the following Stock Numbers (SNs) but it should be noted that they are only referred to, in order to show the types of equipment which could be utilized and are not necessarily of sufficient power rating or physical size, to allow actual bass drum operation to be implemented:

Linear Solenoids:

Standard and Large: SN 346-340; 346-356; 346-362; 349-478

Magnetically

Latching: SN 352-941

Rotary Solenoids: SN 440-032 45 deg; SN 440-048 95 deg.

This introduction to the concept behind the invention raises important questions regarding the requirements of the drummer. Does the drummer want to be able to operate the mallet for the equivalent of a switch closure at the foot, with instant response to operate the mallet very quickly (a sort of "one shot action") or does he want to control the timing of the beat as in the conventional way, by relying on the up and down movement of the foot (where the motion of the mallet always follows the motion of the foot) to time the beat?

An improvement to the above mentioned method of driving the mallet using linear or rotational solenoids, which will allow the motion of the mallet to follow the motion of the foot, would involve controlled, step-wise movement of the solenoid. This immediately suggests the use of a stepper motor to implement mallet shaft rotation but at the same time suggests a reciprocal use of a specially designed linear motor array, which operates in a way resembling that of a stepper motor. The poles of the linear motor would be arranged like those of a stepper motor so that the equivalent of the components of the stator and the rotor would be linearly arranged along the direction of, and around, the axis of, the motor. It is also suggested that the linear induction motor, extensively researched for application to electric trains, could be applied to mallet operation, since it might offer useful means for controlling the acceleration and retardation of the mallet shaft.

Another method which could be used for implementing movement of the mallet towards, and away from, the drum head, relies on the principles of pneumatics. Here, either air or another suitable gas or gases could be used for driving associated equipment. Alternatively, a combination of pneumatic and electrical equipment could be utilized. The latter method lends itself to easier control by the drummer and especially to automatic control. Similar possibilities arise if the principles of hydraulics are applied. However, unwanted electrical noise or noise from any other source within the equipment must be limited or prevented.

Now that the basic alternative methods of operation of the mallet have been introduced, it is expedient to re-emphasize the features of current equipment and to then show how this equipment has been adapted to allow operation of the bass drum mallet remotely.

In one version of current conventional equipment involving rotational operation of the mallet, feedback to the drummer is achieved via the continuous link between the foot pedal and driven mallet, made by a chain which is connected to the foot pedal and which passes over a sprocket fixed to the shaft that the mallet is also fixed to. An adjustable spring attached to the shaft, and anchored to the pedestal on which the whole assembly is mounted, allows the resistance felt by the drummer to be adjusted, and also serves to ensure that the mallet returns to the same "rest" position after the drummer has lifted his foot from the pedal.

In another version of current conventional equipment, a flexible strap attached to the far end of the foot pedal, and to the main shaft of the pedal assembly, provides means for driving the mallet towards the bass drum head. The restoring force for returning the mallet to the rest position and for providing the drummer with resistance against which to work, is once again provided by means of an adjustable spring. In this version, the spring is enclosed in the hollow pedestal, with adjustment implemented via an external screw.

Where operation of the mallet is to be achieved by rotation of a shaft to which the mallet is attached, a variety of methods is available for rotating the shaft electromagnetically. Note that these are in addition to those involving the use of rotary solenoids, already discussed:

1. By using an electric motor attached, via a gearbox, to the shaft to which the mallet is attached. The motor is switched on and clockwise, and counterclockwise and off, by means of a foot-switch operated by the drummer. A switching mechanism causes the direction of rotation of the motor to reverse when the foot pedal is alternately pressed down and released. In a variant of such equipment, a spring mechanism causes the driven shaft to return to its rest position, since the drive to the shaft from the motor, becomes disengaged when the motor is switched off.

One major drawback of such methods, however, is that they do not provide the drummer with any feedback and suffer from total lack of control. They do, nevertheless, allow for implementation of "one-shot" control of mallet operation provided vary fast return of the mallet to its rest position, can be implemented. The use of a transducer to monitor the force with which the foot strikes a special transducer linked pad, can be utilized, together with specially designed circuitry, and mechanisms, to allow the power in the foot action to be transmitted to the mallet, remotely.

2. By using an electric servo-motor and gearbox, with a feedback circuit, for driving the shaft to which the mallet is attached, through a specifiable angle of rotation.

The operation of such equipment is based on the general servo-controller principle, where the value of the voltage output from a servo-potentiometer fixed to the shaft holding the mallet driver, is compared with a reference voltage. In this case, the reference voltage is provided by a potentiometer driven by the foot pedal, where the potentiometer itself is supplied with an accurately controlled reference voltage.

The difference between this derived reference voltage and the voltage delivered by the potentiometer driven by the mallet shaft, which is also derived from a reference voltage, is then used for driving the motor until the difference is zero. For equivalent potentiometers, adjustment of the relative sizes of the supply voltage to each potentiometer provides means for controlling the angle through which the servo-motor turns, and hence through which the shaft holding the mallet, turns, for a given rotation of the potentiometer which is driven by the foot pedal.

The pedal mechanism in designed so that movement of the pedal, alternately downwards and upwards, respectively, causes the shaft to which the mallet is attached, to rotate the mallet respectively, towards, and away from, the drum head. This method is described in considerable detail, later.

3. By using a synchronous motor.

4. By using a stepper motor.

A synchronous motor will offer certain advantages in that it functions by becoming locked to the frequency of the alternating mains supply and therefore lends itself to accurate control of a number of motors which must all operate in unison. This advantage applies to the simultaneous operation of more than one bass drum which is discussed in more detail, later.

However, the ready availability of stepper motors and of appropriate electronic drive circuitry, together with the ease with which such a motor system can be driven by readily available components, has lead to the use of a stepper motor for implementation of the principles of the present invention in a first working prototype.

Later working prototypes utilize the servo-motor principles mentioned under 2, above. Each system has its own advantages and disadvantages and further investigation might reveal that these, or other motor systems, could be utilized in variants of the invention.

It is envisaged that eventually, the apparatus will evolve into custom designed equipment catering for the specific needs of the drummer and his operating environment, and that this apparatus, perhaps using other drive methods, will evolve, further, in order to cater for specific needs.

BRIEF DESCRIPTION OF THE DRAWINGS

In order to explain in more detail, the principles of the invention, reference will now be made to the accompanying diagrams in which:

FIG. 24A is a smaller sized representation of FIG. 22A.

FIG. 24B is a smaller sized representation of FIG. 22B.

FIG. 24C is an alternative representation of FIG. 24A.

FIG. 24D is similar to FIG. 24A but shows, in addition, the foot of a drummer.

FIG. 24E is identical with FIG. 24D but shows the foot of the drummer in a more horizontal inclination.

FIG. 24F shows, in side elevation, a foot pedal assembly resembling that shown in FIG. 24D but having an additional component which is operated by the heel of the drummer.

DETAILED DESCRIPTION OF THE INVENTION

In order to describe the new equipment which is based on the principles of the invention, it is expedient to introduce and describe conventional drum playing equipment in detail, and to expose its limitations.

Figure 1:
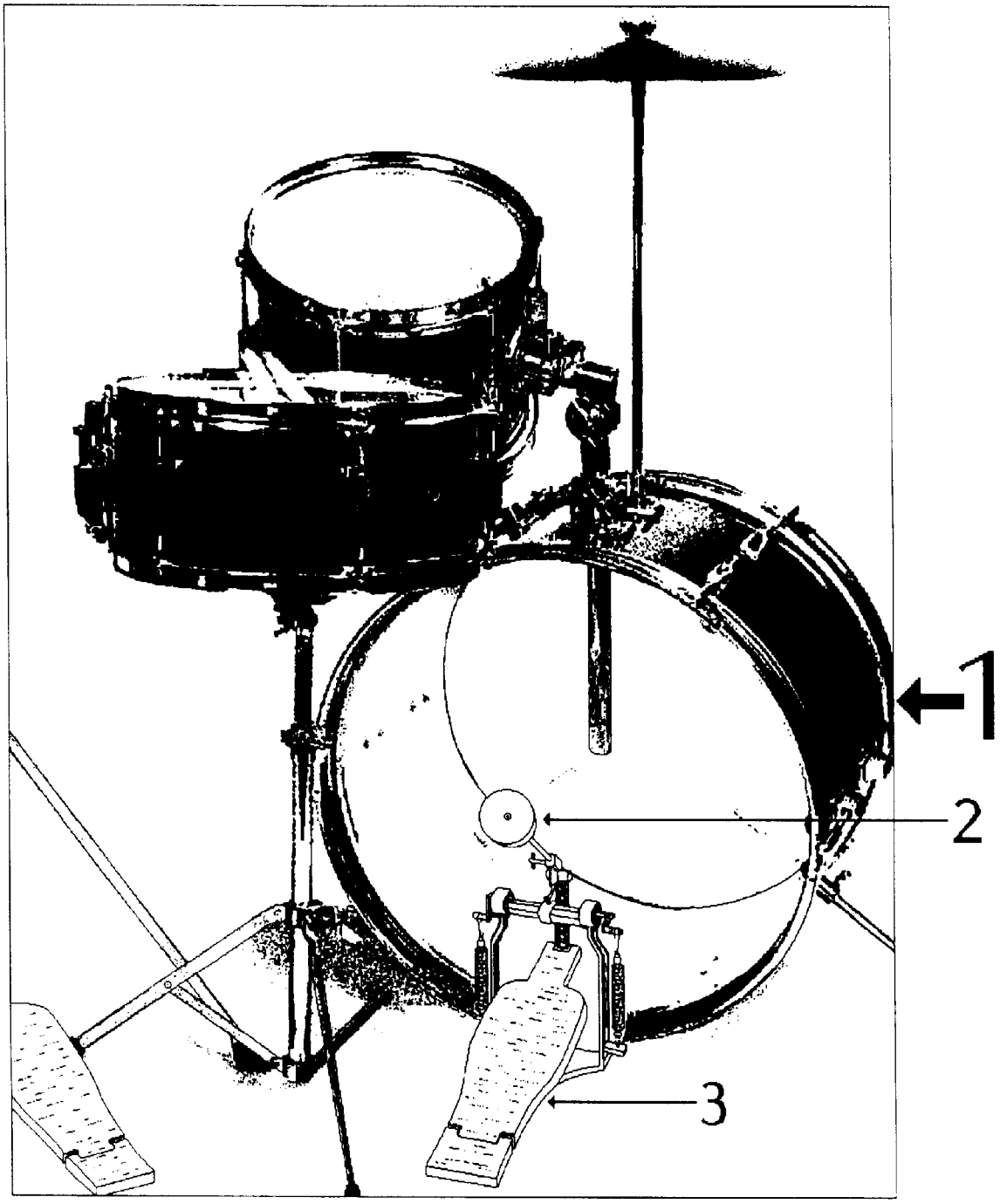
FIG. 1 represents a perspective view of a basic conventional bass drum, and mallet operating mechanism.

With reference to FIG. 1, which represents a perspective view, a bass drum, 1, has a mallet, 2, attached to a mallet operating mechanism, which is driven by a foot pedal, 3. It is to be noted that part of the supporting stand for a hi-hat can be seen to the left of the diagram and that the hi-hat itself is just out of view to the left. The functional elements of the conventional foot-pedal-mallet-operating mechanism are described later, with reference to FIGS. 4 and 8.

Figures 2A, 2B:
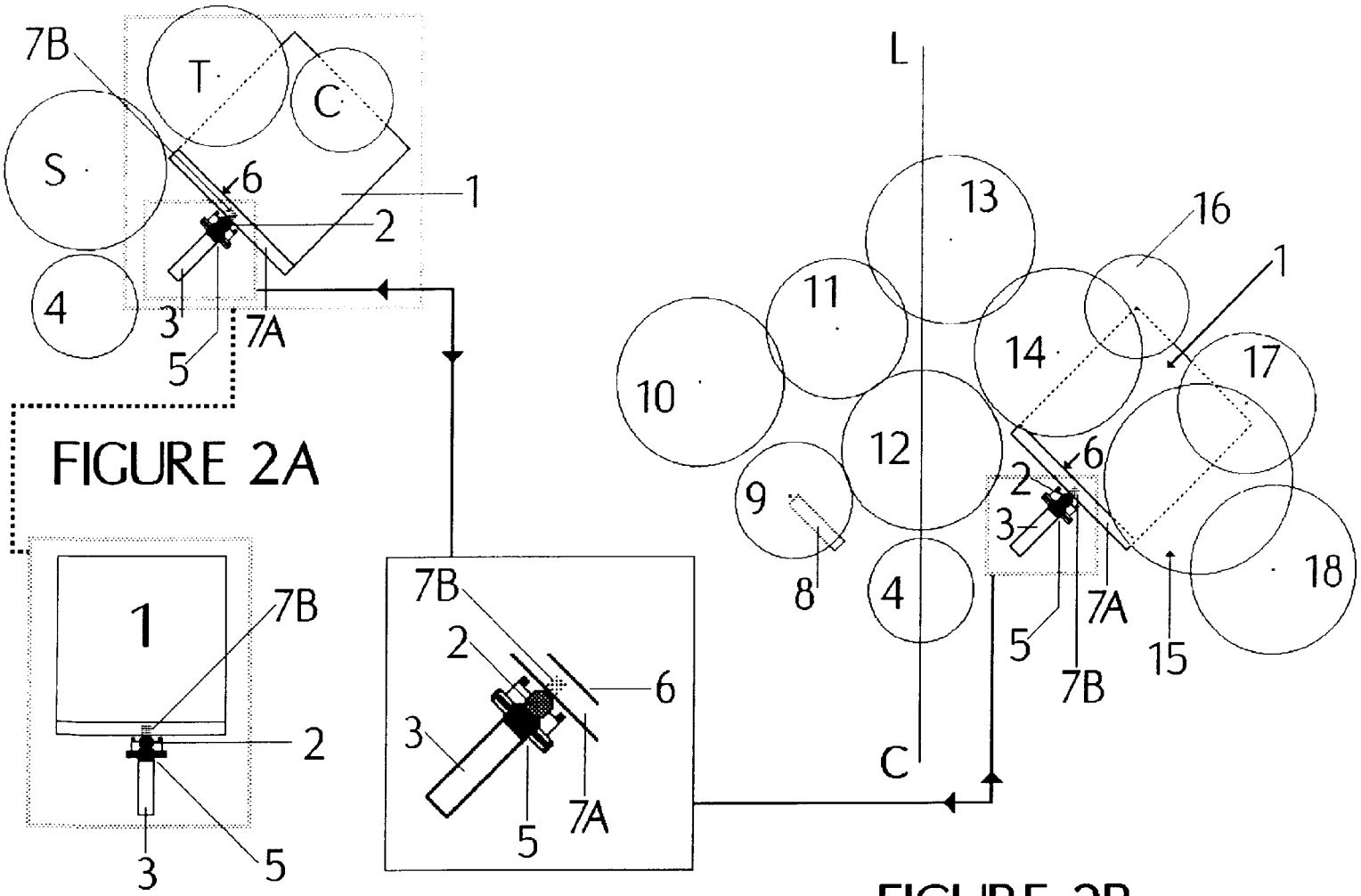
FIG. 2A represents a plan view of the equipment shown in FIG. 1, in relation to the position of the drummer's stool.
FIG. 2B represents a plan view of the layout of the components of a sophisticated professional conventional drum-kit, demonstrating how the position of the bass drum fixes the location of the other components and the positions of the drummer's feet.

With reference to FIG. 2A, which represents a plan view, the elements of the basic drum kit shown in FIG. 1 are reproduced. In the upper part of the diagram, elements of the kit are shown in relation to the position of the drummer's stool, 4, and with the foot pedal, 3, and bass drum, 1, in the preferred "45 degree" orientation. In the lower part of the diagram (linked to the upper part by means of a broken line) the foot pedal, 3, and the bass drum, 1, are shown in their traditional, "straight ahead" orientation.

With further reference to the upper part of FIG. 2A, the drummer, seated on the Stool, 4, operates the bass drum foot pedal, 3, by means of the right foot, and movement of this pedal operates the mallet driving mechanism, 5, which creates sound as a result of the impact of the mallet, 2, with the head, 6, of the bass drum, 1. The mallet driving mechanism, 5, is clamped to the rim, 7A, of the bass drum, 1, by means of an adjustable clamp, 7B, attached to the front part of the base of mechanism, 5. An enlarged view of these components is shown in the inset diagram.

With reference to FIG. 2B, which represents a plan view, the arranged elements of a typical, conventional, professional, 11 piece drum-kit, are shown in relation to the positions of the two foot pedals (one hi-hat pedal, 8, and one bass drum pedal, 1) the bass drum, and other components, for a right-handed drummer. The center line, CL, can be assumed to represent the top horizontal edge of a vertical plane of symmetry dividing the body of the drummer into two halves, shown here as a division of the stool, 4, into two halves, and it can be seen that the drum-kit is mostly to the right of line CL. For a left-handed drummer, most of the equipment would be to the left of line CL.

Foot pedal, 8, operated by the left foot, drives the top cymbal of a pair of cymbals, 9, known as a "hi-hat". Beyond, and to the left of the hi-hat, is a stand-mounted cymbal, 10, and next to this is a tom-tom, 11. A snare drum, 12, is directly in front of the drummer, and beyond this is a stand-mounted cymbal, 13. Second and third tom-toms, 14 and 15, are mounted on the bass drum, 1, and behind these are cymbals, 16 and 17, which are of differing sizes. Immediately to the right of the drummer is a stand-mounted cymbal, 18.

It can thus be readily seen that the sizes of tom-toms, 14 and 15, of cymbals, 16 and 17, and of the bass drum, 1, are all limited by the volume of the space available to the drummer from the seated position defined by the stool, 4. This space is itself dictated by the extent of the reach of the right hand and foot of the drummer. If the bass drum in relatively large, the tom-toms etc., are smaller, and vice versa.

The above description of a typical, conventional, professional drum-kit used by a right-handed drummer, demonstrates the boundaries of the Critical Performance Area (CPA) and it is now expedient to introduce the range of options which become available to the drummer when using equipment based on the principles of the invention.

Thus the combination of foot driven and mallet driving equipment incorporating the principles of the invention is known as the Jet Black Power Bass Drum Pedal, which comprises two main components: the Footplate Module and the Mallet Module, which can be operated remotely from each other, either via an electrical connection, with electrical power derived from the mains supply or from any other source e.g. a battery pack or generator, or via a wireless electromagnetic, or ultrasonic, communication link.

With the Jet Black Power Bass Drum Pedal, it is now possible, for the first time, to move the bass drum away from the foot pedal, to any location from which the electrical connection, or wireless communication link, between the Footplate and Mallet Modules can be maintained and furthermore, this can now be outside the CPA altogether, into a new area known as the Extended Performance Area (EPA) or the Unlimited Performance Area (UPA). This means that a major part of the CPA is liberated and this retrieved space can be utilized for other equipment, which will broaden the limits of drum-kit configuration, stimulating industry production and raising drum-kit performance to new technical heights.

A further feature of the new equipment is that the drummer is now able to locate the Footplate Module wherever he finds it most suitable, and/or comfortable, without having to compromise on the space available within the CPA. Where a smaller bass drum may have had to be used in the past, in order to allow more space to be available for tom-toms and also to utilize the CPA to its maximum, it is now possible to use any size of bass drum and indeed several, of varying sizes, located just outside the CPA or even more remotely, and all playing in unison or according to special sequences, with all, or some, operated by one drummer, with some, operated by other drummers.

This facility will have a spectacular impact on stage production and performance, when its full potential is realized, and new techniques will be possible in recording situations.

The Footplate Module is available in a range of variants which allow for various styles of play and one variant in particular, allows the drummer to operate the pedal solely with the heel off the ground. Thus, for the first time, one variant of the Footplate Module of the Jet Black Power Bass Drum Pedal matches the playing mode adopted by most professional drummers, through its up and down action, as opposed to heel pivotal action, rendering a further degree of comfort, unattainable with a conventional pedal, where there is a constant tendency for the foot to slide down the sloping footplate.

Because the Jet Black Power Bass Drum Pedal utilizes electronic circuitry for driving the Mallet Module, it is now possible to arrange for the Mallet Module to play, unattended, via control signals supplied by a Jet Black Programmable Module. This provides the drummer with the freedom to develop and implement, hitherto inconceivable, additional rhythmical innovation, while executing a "stand up" performance.

The Jet Black Power Bass Drum will deliver power from the Mallet Module in sympathy with that delivered at the Footplate Module or it can be adjusted to provide a level of power at the Mallet Module which is greater than that delivered at the Footplate Module. This, in effect, means more power, for the same amount of work.

One way in which the power can be controlled is by altering the electrical sensitivity of the response of the Mallet Module to the movement of the Footplate Module.

Another way is to use an adjustable gearbox between the initial motor drive and the apparatus operating the mallet but, with this method, the equipment is mechanically more complicated.

Whichever method is finally used, the new system allows more power to be available for less power input by the drummer.

Although the Jet Black Power Bass Drum Pedal is designed to operate with an electrically driven Mallet Module, it is possible for variants of the design to deliver the up and down action of the foot of the drummer to a modification of a conventional style of mallet driver which does not rely on electricity for operation. Such variants can, for instance, incorporate a rack and pinion gear arrangement such that the up and down movement of the pedal causes rotation of the shaft of the mallet driver. Other mechanisms can incorporate standard, or specially designed, lever systems, involving reciprocating and rotational motion, in order to implement mallet operation.

It is pointed out with reference to the foregoing and following text, that it is likely that the angle of rotation of the mallet operating shaft will be similar to that for conventional mallet operating equipment, which is about 45 degrees, although the availability of greater power may reduce this angle.

It is further pointed out that stepper motors are designed to operate for long periods with their rotor held in a fixed "step" position, and with rated current in the winding or windings. Thus, stalling is no problem for a stepper motor, whereas, for most other types of motor, stalling results in a collapse of back e.m.f. and the generation of a very high current which can rapidly lead to a "burn-out". However, such problems have not been encountered with prototypes involved in connection with this invention.

The principle parameter which has to be considered for a stepper motor, is the holding torque, and this will be the torque required to deliver the power-stroke of the mallet against the head of the drum. This will need to be greater than the torque required to keep the mallet, and associated mechanical linkages, in any rest position, when the motor is active.

One other important aspect of stepper motors which is worthy of consideration is their tendency to click when operated, since they are truly digital. This clicking can be reduced, to some extent, by having as fine a stepping angle as possible (using established operating modes such as half-, or mini-, stepping). Furthermore, if it was important to control it, the adoption of mallet operating equipment based on the use of stepper motors or their principles of operation, could provide an impetus for development of quieter stepper motors. If it should become a nuisance due to sound pick-up by stage amplification, other motor techniques should be adopted or otherwise, techniques for lessening the influence of such noise should be adopted.

Figure 3:
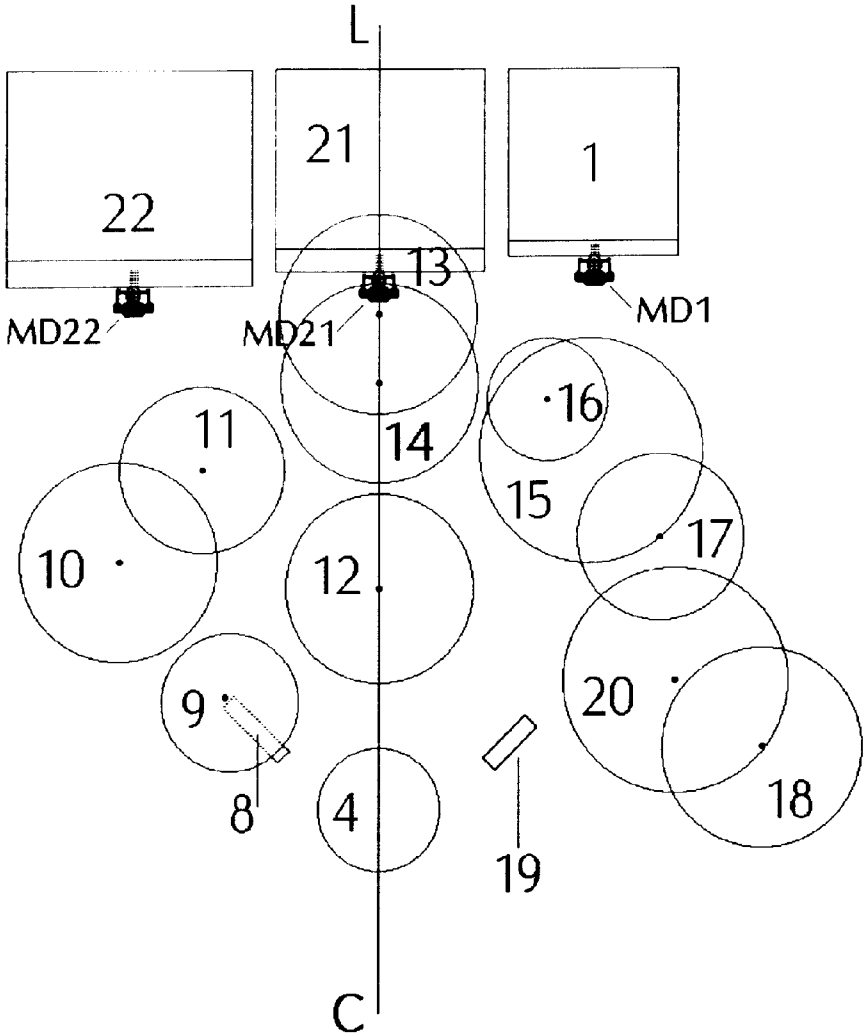
FIG. 3 represents a plan view of the new layout of equipment which is possible, and one position of the new foot pedal, when the principles of the invention are implemented.

With reference to FIG. 3, which represents a plan view, the components of a 14 piece drum-kit are shown in the arrangement which is possible when using the Jet Black Power Bass Drum, which consists of the Jet Black Bass Drum Footplate and the Jet Black Bass Drum Mallet Module, which are both based on the principles of the invention. For brevity, in this specification, the terms Bass and Drum may be dropped from the definitions/titles given later.

With further reference to FIG. 3, the center line, CL, can be seen to divide the circle representing the Stool, 4, into two halves, with the components of the drum-kit being essentially the same as those shown in FIG. 2B, but with some additional elements. It can be seen that the bass drum, 1, has now been moved outside the conventional Critical Performance Area (CPA) because the conventional foot pedal (pedal, 3, shown in FIGS. 2A and 2B) has been replaced with the Jet Black Footplate Module, 19, which allows the drummer to operate bass drum, 1, by means of an electrical link (not shown) to Jet Black Mallet Module, MD1 which is clearly too far away to be reached by the drummer using the conventional pedal, 3.

It can also be seen that an additional tom-tom, 20, has now been included in the drum-kit, in the position previously occupied by bass drum, 1. Any such equipment which was originally mounted on bass drum, 1, is now mounted on floor stands. It can also be seen that, two additional bass drums, 21 and 22, of different size from one another and larger than bass drum, 1, are also outside the CPA. Bass drums, 21 and 22 are also operated from pedal, 19, by means of an electrical link (not shown). The new mallet drivers Mallet Modules MD1, MD21, and MD22, are shown in their operating positions in front of the bass drums, 1, 21, and 22, respectively.

Furthermore, it is pointed out that the use of three bass drums allows a more powerful "Bass End" to be achieved.

It is pointed out, with reference to FIG. 3, that, for convenience, only a simple representation of the Footplate Module, 19, and of the three bass drums, 1, 21 and 22 has been made. A more detailed description of the electrical link between the Footplate Module, 19, and the bass drums, 1, 21 and 22, is made later, with reference to FIGS. 15, 16A and 16B.

It is also pointed out that the pedal, 8, operating the hi-hat, 9, could be similar to pedal, 19, provided that the hi-hat was driven by electricity in the same way as are bass drums, 1, 21 and 22, in which use of a suitable solenoid or motorized assembly would be required. This would allow the hi-hat to be moved closer to other equipment than is possible with conventional drum-kits, or to a position outside the CPA, if desired. However, it is appreciated that the top cymbal of the hi-hat has to be hit by the drummer and therefore must be within his reach.

The exclusion of the bass drum(s) from the CPA also allows the tom-toms (or any of the other equipment which may be incorporated within a drum-kit) to be larger, once again providing the facility for greater variation in the nature and volume of the Real Sound generated directly from the drum-kit.

Figure 4:
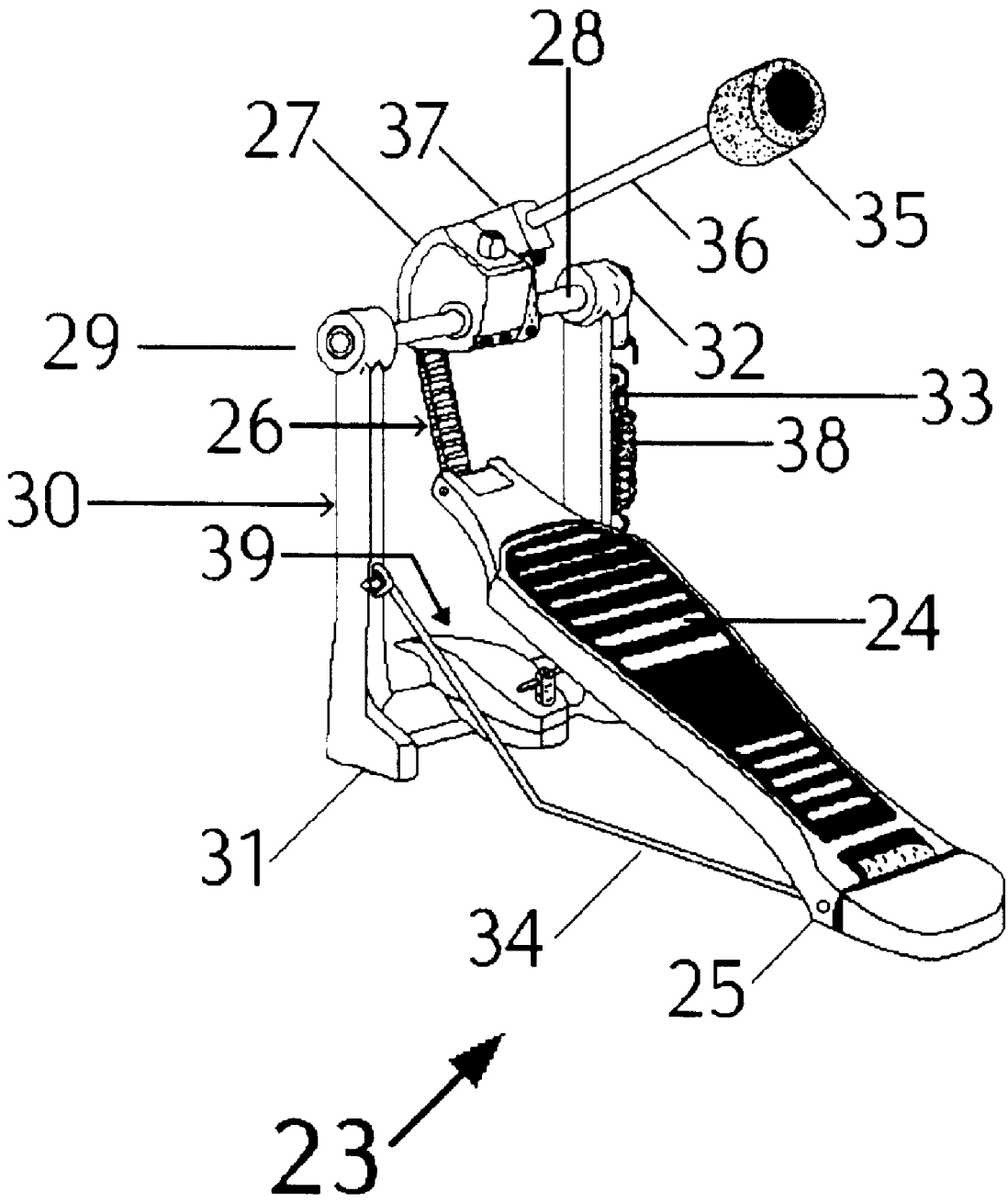
FIG. 4 represents a perspective view of one type of conventional pedal mechanism for driving a mallet against a bass drum head.

With reference to the perspective diagram shown in FIG. 4, a conventional, foot-pedal-mallet-driving mechanism, 23, has a foot pedal, 24, whose rear extremity has a hinge, 25, and whose front extremity is attached to one end of a chain, 26, which passes over the teeth of a sprocket, 27, mounted on a shaft, 28. The left hand end of shaft, 28, is located in a bearing, 29, which is itself mounted in the top end of the left support pillar, 30, of a supporting frame, 31. The right hand end of shaft, 28, is located in a bearing, 32, mounted in the top end of the right support pillar, 33, of the frame, 31. The foot pedal, 24, is connected to the frame, 31, by means of a compressible, "V" shaped hoop clamp, 34, which locates in sockets in the rear extremity of the pedal, 24, and in the supporting pillars, 30 and 33, of the frame, 31.

Downward force on the pedal, 24, thus causes the chain, 26, to pull the sprocket, 27, thus rotating the shaft, 28. A mallet, consisting of a head, 35, mounted on a shaft, 36, and connected to the shaft, 28, by means of an adjustable clamp, 37, can thus be rotated respectively, towards and away from, the bass drum head, as a result of the downwards and upwards movement, respectively, of the foot pedal, 24.

In order to ensure that the mallet is returned to its rest position when the foot is lifted, an adjustable restraining spring, 38, is anchored to the base of the right hand and of the frame, 31 and to an extension of the shaft, 28, which protrudes through, and beyond, the right hand bearing, 32. The whole mallet driving assembly, 23, is provided with an adjustable clamp, 39, so that it can be attached to the rim of the bass drum.

In other variants of the foot pedal mechanism, the chain, 26, is replaced by a flexible metal, or plastic, strap.

Now that the conventional pedal operated mallet driving equipment has been described, it is expedient to describe the new system.

Figure 5:
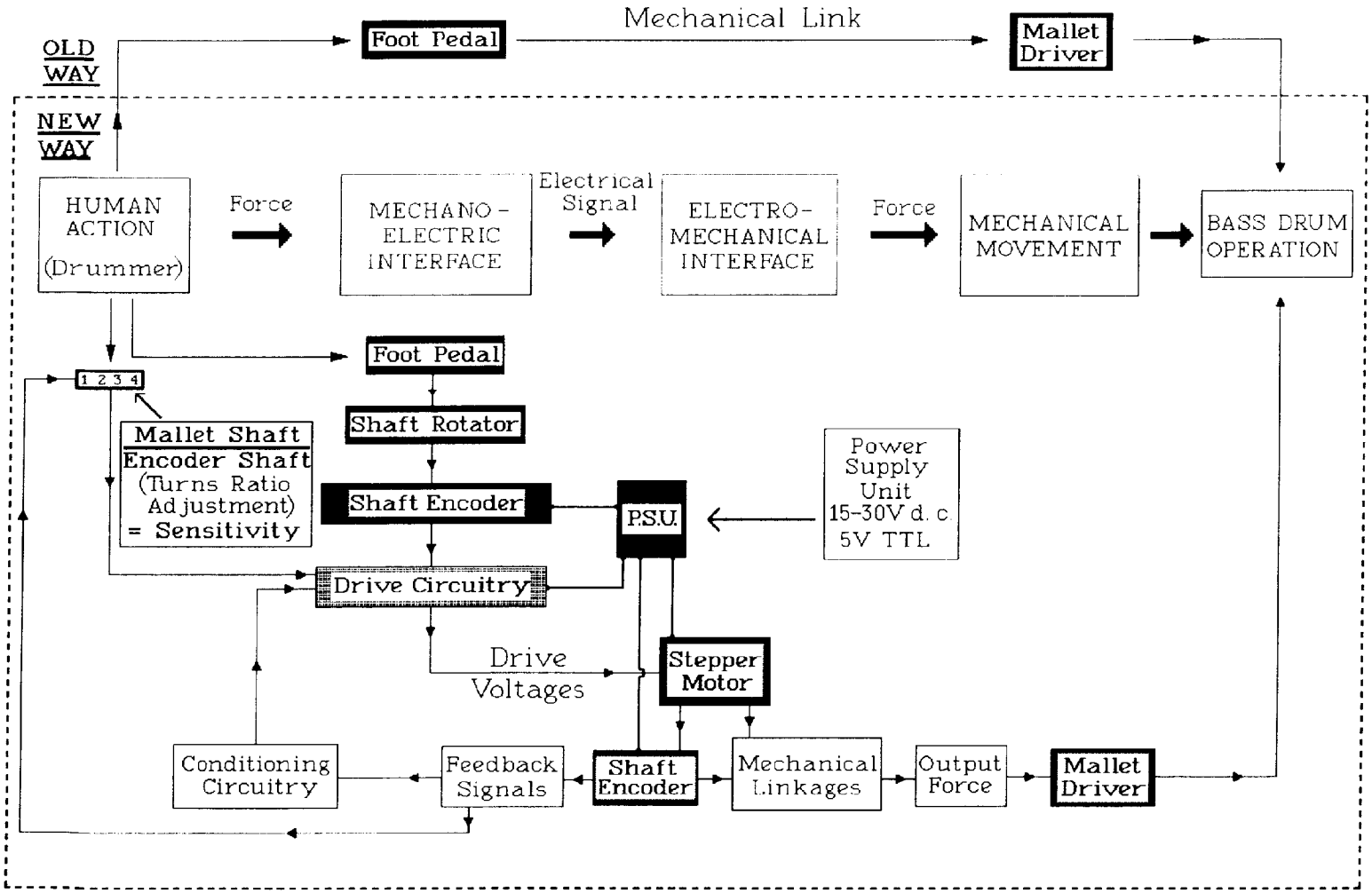
FIG. 5 is a schematic diagram showing the stages involved in implementing the principles of the invention.

With reference to the schematic diagram shown in FIG. 5, it can be seen that the previously explained requirement for flexibility in the location of the bass drum dictates that the force created by the foot of the drummer, which is conventionally, directly applied to the mallet driving mechanism attached to the bass drum, be re-created remotely from the drummer by means of electrically driven equipment.

This can be implemented by arranging for the movement of the drummer's foot to generate an electrical signal which can be transmitted along an electric cable, or into an electromagnetic signal which can be transmitted without a cable as a radio or infra-red signal, etc., or even an ultrasonic signal. The transmitted signal has then only to be converted back to a mechanical force, so that the base drum can be operated.

In the apparatus to be described later, the electrical signal is in the form of a series of square wave pulses which are generated by means of an optical shaft encoder or digital potentiometer, attached to a shaft which is rotated by the operation of the foot pedal. The generated pulses are then supplied to electronic drive circuitry which produces voltages on four output wires connected to the four poles of a stepper motor. The circuitry provides these voltages in the combinations necessary to advance the stepper motor incrementally for each pulse from the shaft encoder.

The output from the stepper motor drive shaft can be used to drive the mallet at the bass drum directly, or the drive to the mallet can be taken from the motor via a gearbox. The use of a gearbox provides for greater torque for driving the mallet and also provides mechanical means for adjustment of the sensitivity of the driven mallet to the movement of the foot pedal, electronic means for adjustment of this sensitivity are described later.

It is likely that, eventually, custom designed equipment catering for specific needs will evolve.

The direction of rotation of the motor can be controlled by altering the level of the voltage on an input port of a drive board in the drive circuitry.

This level can be controlled automatically, as a direct consequence of the direction of rotation of the shaft encoder, since that has two output ports, A and B, which are 90 degrees out of phase with each other.

For clockwise rotation of the shaft encoder, channel A leads channel B, while for counterclockwise rotation, channel B leads channel A.

Thus, by taking the channel A and B outputs to a 74LS14 Schmitt Trigger, with appropriate wiring according to TTL (Transistor to Transistor Logic) convention, rotation of the shaft encoder will cause the magnitude of the voltage on Channel A to rise to the TTL High Level, and be instantly converted to a TTL Low, which will put the circuitry in the drive board in a state such that pulses from Channel B will drive the motor in a clockwise direction.

Pulses from channel B will continue to drive the motor in this direction, provided that the shaft of the optical encoder is rotated in a clockwise direction, since the buffered and inverted output from channel A, will always be at a TTL Low level, when each negative-going pulse from channel B occurs.

When the shaft encoder is rotated in a counterclockwise direction, channel B leads channel A, so that when the negative-going pulse from Channel B occurs, the output from Channel A will be in the Low state and the converted output from the 74LS14 integrated circuit from Channel A, will be in the TTL High state. The motor will therefore continue to rotate in the counterclockwise direction.

Thus, by arranging for the rotation of the shaft encoder to be implemented by means of a pedal mechanism, such that downwards and upwards movement of the pedal, rotates the shaft of the shaft encoder, clockwise for downward movements, and counterclockwise for upward movements, of the pedal, the stepper motor can be made to rotate clockwise, and counterclockwise, respectively. A mallet attached to the shaft of the stepper motor will thus swing clockwise and counterclockwise accordingly, in unison with the movement of the pedal.

By these means, therefore, it is possible to operate a bass drum mallet remotely, and thereby provide flexibility in location of bass drum, and other equipment.

It can be seen from FIG. 5, that a 5 volt TTL power supply is required for the shaft encoder and that a 15 to 30 volt supply is required for the drive board and stepper motor.

In addition to the use of purely mechanical methods, the sensitivity of the movement of the mallet driver to the movement of the foot pedal can be adjusted, and feedback information can be received and processed, via use of a set of thumbwheel switches together with appropriate circuitry (labeled 1234). This is described in more detail later.

It is pointed out, with respect to the foregoing description, that the power available for driving the mallet is directly dependent on the power which can be delivered by the stepper motor or by the gearbox connected to the stepper motor. The current output from the drive circuitry determines how much power is available for the stepper motor driving the mallet, and a larger motor will require a greater power output from the drive circuitry. However, since the drive voltages themselves can be used to switch relays (solid state relays or other types, or transistors, e.g. the high current handling, Darlington Pairs) on and off, larger motors can be operated from drive circuitry having a much lower power handling capacity. This is explained further, later in the text.

With reference to the schematic diagram shown in FIG. 6, which is not to scale, a panel mounting, digital potentiometer, 40 (see list of components at the end of the specification) is shown in side-elevation and has a shaft, 41, which is driven by the action of the foot pedal by means of a coupling, 42, connecting shaft, 41, with the shaft, 43, of a conventional foot pedal-mallet operating mechanism, similar to that shown in FIG. 4 and later to be described in more detail with reference to FIGS. 8 and 9. Grub screws, 44, 45 and 46, 47, allow the ends of the two shafts to be clamped into the coupling.

Note that the digital potentiometer, 40, could be replaced by the shaft encoder referred to with reference to FIG. 5.

The digital potentiometer, 40, is supplied with a 5 volt TTL supply at its 0 Volt and 5 Volt, supply terminals and provides square wave pulse outputs from its A and B Output Channels.

In order to provide an interface between the outputs from channels A and B and the stepper motor drive board (described later with reference to FIG. 7) two TTL integrated circuits are utilized. These are shown in plan view in FIG. 6 and are: a 74LS14 low-power Schottky, Hex (Inverting) Schmitt Trigger, 48, and a 7493, Binary, divide by 16 counter, 49.

It can be seen that the logic level of the outputs from Channels A and B of the shaft encoder, 40, will be inverted by the Schmitt Trigger, 48, so that their phase separation will be maintained. The Schmitt Trigger thus serves to buffer the outputs from the digital potentiometer, 40.

Figure 7:
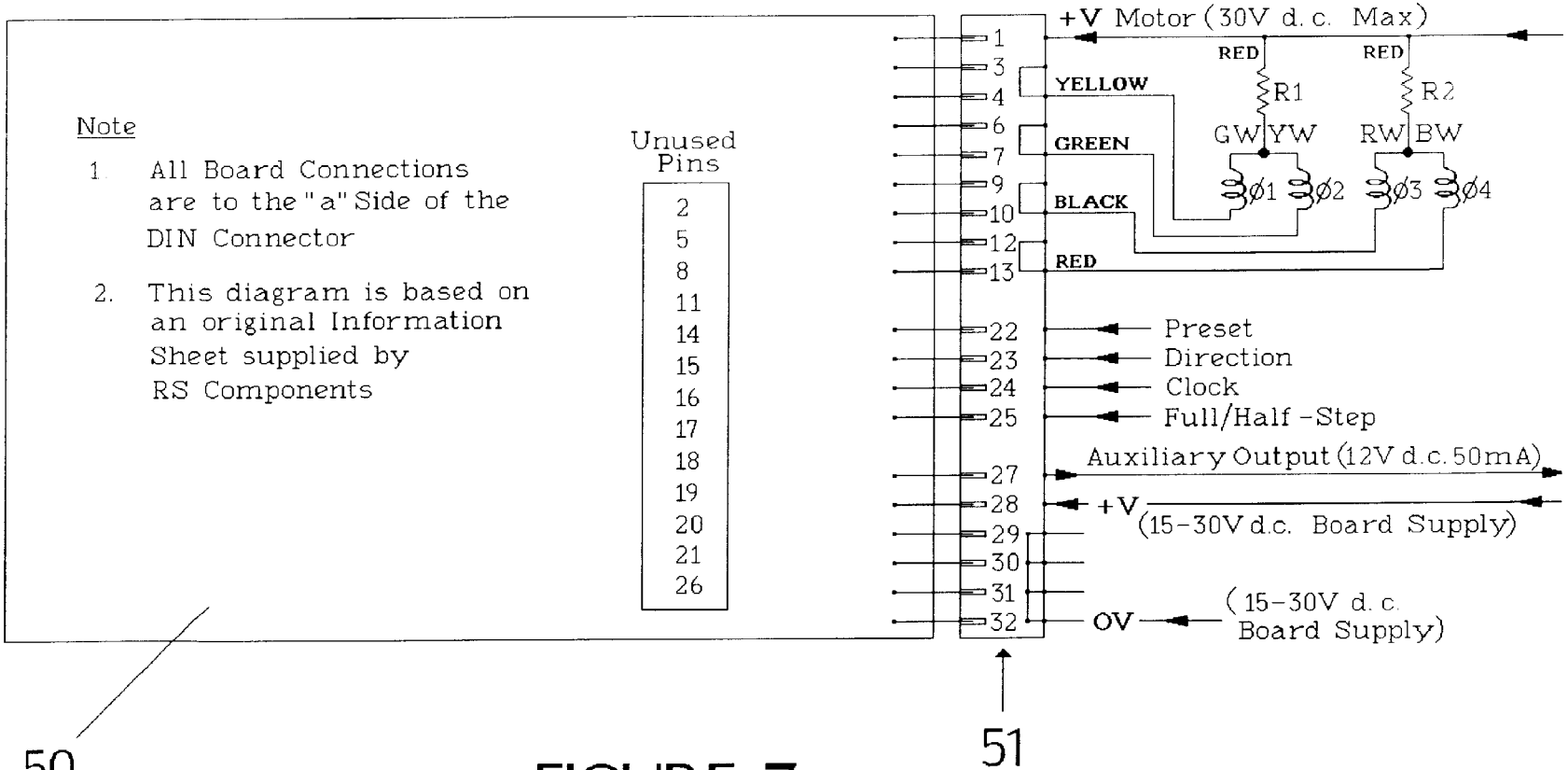
FIG. 7 is a schematic diagram of a representation of some of the drive circuitry used for implementing rotation of the mallet driving mechanism via a stepper motor.

After entering and leaving the Schmitt Trigger, 48, the output from Channel B enters the Clock Input of the Counter, 49, and the Q2 output from Counter, 49, is taken to the Clock Input of the drive board, 50 (see FIG. 7). The pulse sequence from Channel B is thus divided by 2.

It can thus be readily seen that, by appropriate choice of the output port from the Counter, 49, the angular rotation of the shaft of the mallet operating mechanism driven by the stepper motor, for a given rotation of the Shaft, 41, of the digital potentiometer, 40, and hence of the Shaft, 43, of the new mechanism operated by the foot pedal (described later with reference to FIG. 9) can be adjusted.

It is possible to provide more sophisticated means of adjustment of the sensitivity of the system by utilizing more advanced circuitry. Thus, for instance, the Q2, Q4 and Q8 outputs, from the 7493 Counter, 49, could be taken into the data input ports of a 74153, 1 of 4 data selector, so that a divide by 2, divide by 4, or divide by 8, function is implemented on the output to the stepper motor drive board. The required address can be selected on an appropriately wired thumbwheel switch or by use of a keyboard with appropriate circuitry. Note that, for this application, the Q1 output of the Counter, 49, has to be wired to the Clock 2 input of the Counter.

A more flexible arrangement would involve use of a random access memory, integrated circuit, whose address lines can be programmed to provide any desired sequence of outputs.

The ultimate in flexibility would be achieved by use of microprocessor based equipment, which offers the advantages of being software driven.

Figure 6:
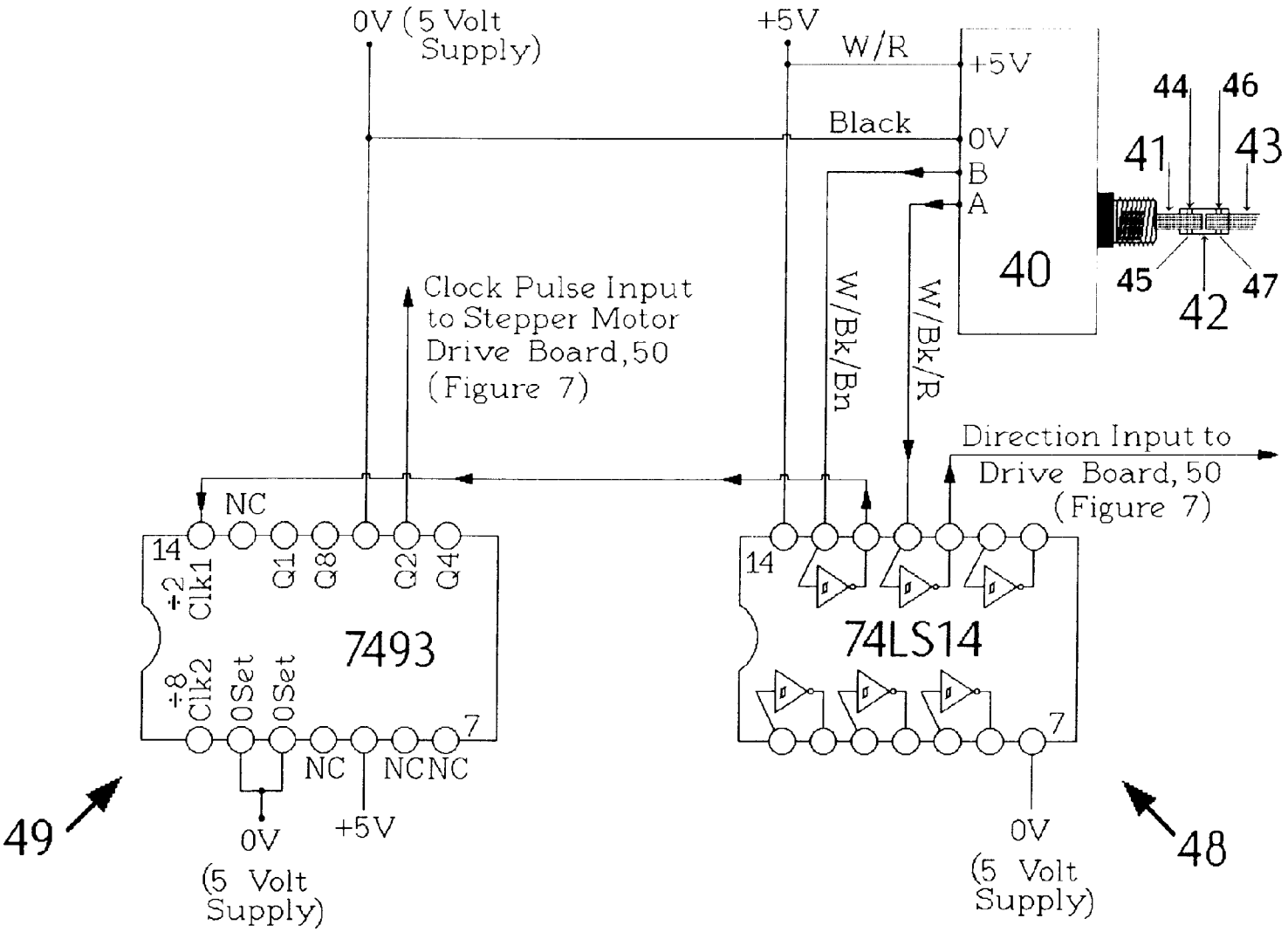
FIG. 6 is a schematic diagram of equipment and circuitry used for obtaining drive pulses from the operation of the foot pedal by the drummer.

It should be noted that the digital potentiometer shown in FIG. 6 is not recommended for driving motors (this is explained in the information sheet supplied by RS Components along with the digital potentiometer). However, neither the digital potentiometer nor the stepper motor is rotated continuously at high speed, and the requirements of the present system therefore do not reach the limits stipulated for the digital potentiometer. It has therefore served perfectly, in the practical demonstration of the principles of the invention.

Custom designed equipment based on the principles of the invention described in this patent specification can utilize highly accurate and reliable, optical shaft encoders which are either directly available or which can be custom designed to suit the specific requirements of the invention. One parameter which needs to be given careful consideration is the number of pulses per revolution of the shaft encoder.

By use of appropriate wiring, and additional circuitry, it is possible to arrange for the operation of one foot pedal to drive any number of mallets and hence bass drums, which can be located anywhere within reach of wiring or any feasible wireless communication link. The scope of operated equipment is limited only by the power available from the mains supply.

Furthermore, if electromagnetic radiation (e.g. radio) is used for the link between the foot pedal and the equipment driving the mallet(s), the drum(s) could be anywhere in the world. Any of the techniques currently employed for the remote operation of equipment could be adapted to operate a bass drum by use of the aforementioned methods. It is pointed out, however, that, in order to prevent spurious operation, appropriate, encoding, scrambling, protecting, screening, circuitry, should be designed and utilized.

It is also possible, by using appropriate circuitry, e.g. microprocessor based circuitry, to operate the bass drum mallet(s) at a pre-selected rate, in the same way that a metronome operates, and/or in a varied sequence, but with greater flexibility it is also possible to operate one or more hi-hats in this way.

Also, because the mallet driving equipment does not have to be placed on the floor, it is now possible to have bass drums in any orientation which will allow the new electrical means for operation of the mallet to be implemented. Thus, for instance, the bass drum can be placed so that its head is in a horizontal plane while the Drum is on the floor, or, alternatively, it can be suspended; the wires in the latter case could be above the Drum as in the case of suspended electrical lighting. This means of playing lends itself, particularly, to operation under radio control.

It is also possible to mount bass drums, one on top of the other, forming a tower of drums. These could be struck at the same time or at staggered times, thus giving rise to interesting variations in sound and beat, especially if lighting effects are used as well. The invention also lends itself to exploitation in special shows incorporating very large items of equipment which can be in varied locations e.g. behind and/or above, the audience and/or band.

With reference to the foregoing, it is pointed out that, where more than one bass drum is played, each drum could be "beaten" with a different size/weight of mallet and/or the heads of the drums could be tensioned to produce different notes. Such tensioning can also be carried out under remote control and will therefore provide for even greater flexibility in the standard of performance which can be achieved.

As a consequence of the use of electricity to drive the mallet, the drummer now has power-assistance, so that the power delivered at the bass drum can be controlled, and is potentially much greater than that available from the body alone. Furthermore, since the distance through which the foot moves for a given movement of the mallet, can also be controlled, the drummer can adopt a new style of drumming involving different movements of the foot and/or foot/leg/thigh. Furthermore, simple systems can involve switch operation, with relatively small movements of the foot.

As already stated, these features also give rise to the further facility for remote adjustment of both the power which can be delivered to the mallet and, the ratio of mallet movement to foot pedal movement. Moreover, since mallet operation is achievable through provision of a pulse sequence, it is possible for the drummer to operate a mallet remotely, by use of a system which generates pulses as a result of interruption of light beams or electromagnetic beams in general. Here, a set of beams of electromagnetic radiation could be arranged to "feed" appropriate sensors, which themselves are connected to appropriate circuitry which can produce a pulse whenever the beam is interrupted.

With such equipment, the motion of the foot of the drummer or even the hand, or any other part of the body, e.g. the finger, could therefore be used to generate a pulse "stream" which could be used to drive a stepper motor system having a mallet attached to it as already described with reference to the foregoing account. This is described in more detail, later, just after the description of FIG. 20.

With reference to the schematic diagram shown in FIG. 7, a 4-Phase Unipolar stepper motor drive board, 50, is connected via a 32 Way Socket, 51, to a foot operated pulse generating system (to be described later with reference to FIG. 9) to the circuitry already described with reference to FIG. 6, and to a stepper motor/mallet driving assembly, to be described later with reference to FIGS. 10 and 12.

The board supply voltage is from 15 to 30 Volts d.c. with the positive side provided via Pin 28 of Socket, 51, and the Zero Voltage provided at Pin 32, with Pins 29, 30, 31 and 32, connected together. The common positive supply for the stepper motor is taken to Pin 1 and this can be the same supply as for Pin 28. The Zero Volt supply for the four phases of the stepper motor is provided in the necessary sequence for correct rotation of the motor, by the drive board circuitry as follows:

Pins 3 and 4 (Yellow, Ø1)

Pins 6 and 7 (Green, Ø2)

Pins 9 and 10 (Black, Ø3)

Pins 12 and 13 (Red), Ø4)

External Control signals are supplied as follows:

| | |
|---|---|
| Pin 22 | Preset. |
| Pin 23 | Direction of Motor Rotation. |
| Pin 24 | Clock Pulse input, i.e. from digital potentiometer, 40, shown in FIG. 6, or from a suitable optical shaft encoder. |
| Pin 25 | Full/Half-Step, operation of the stepper motor. |

There is also an auxiliary 12 Volt d.c. supply at 50 mA, available at Pin 27. Unused Pins are: 2, 5, 8, 11, 14, 15, 16, 17, 18, 19, 20, 21 and 26.

In order to protect the windings Ø1 to Ø4, of the stepper motor, resistors R1 and R2 are connected as shown between the positive supply side of the windings and the positive side of the supply. The values of R1 and R2, which are identical, are calculated as follows:

$$R1=R2=+V \text{ motor}-\text{rated winding voltage rated winding current}$$

The maximum power, MP, which can be dissipated through R1, or R2, is given by:

$$MP=(\text{rated motor current})^2 \times R1 \text{ (or } \times R2)$$

The stepper motor (referred to later) used for demonstrating the principles of the invention is supplied by RS Components under stock number 440-464 and has the following characteristics:

| | | | |
|---|---|---|---|
| Rated Voltage | 3 Volts | Rated Current | 2 Amps |
| Resistance | 1.5 Ohms | Inductance | 5 mH |
| Detent Torque | 40 mNm | Holding Torque | 1200 mNm |
| Step Angle | 18 deg. | Step Angle Accuracy | 5% |
| Insulation Class | B | | |

At a supply voltage of 12 volts d.c., these data require R1, R2 to have the values 4.5 Ohms at a power rating of 18 Watts.

The arrangement of the Footplate Module, power supply unit, interfacing circuitry, drive board, and Mallet Module, is described later, with reference to FIG. 15, and it is now expedient to introduce the prototype equipment utilized for implementing the principles of the invention, by first describing the equipment which has been modified to make the prototype.

Thus, with reference to FIG. 8, which represents a perspective view, a conventional, foot-pedal-operated, mallet-driving-assembly, 52, similar to that already described with reference to FIG. 4, has a base-plate, 53, on which elements of the whole assembly are mounted. For convenience in describing the diagram, elements of the assembly which have a similar function to those already described with reference to FIG. 4, retain their identities in FIG. 8; other elements will be introduced accordingly.

In this variant, a heel rest, 54, is situated immediately behind the rear axle, 25, and the mallet, 35A, attached to shaft, 36, has a felt extension, 35B. The mallet shaft, 36, is locked in the Clamp Boss, 37, by means of a locking screw, 37A, and the Clamp Boss itself is locked to the hexagonal sectioned shaft 28, by means of screw, 37B.

Variants of this assembly, have the chain sprocket (27, FIG. 4) separately located on the shaft, 28, thus allowing for a variation in the method of adjustment of the "throw" of the mallet and of its position along the shaft, 28. Fine adjustment of the restraining spring, 38, is achieved by means of a threaded bolt, 55, attached to the lower end of the spring, 38, which passes through a hole in a boss, 56, on the base of the right hand support pillar 33, and into a threaded hollow stud, 57. A knurled adjuster 58, allows the bolt, 55 to be locked into the hollow stud, 57. Screw-down Spikes, 59A (and 59B, not shown) allow the whole assembly to be locked in place on the floor.

Figure 8:
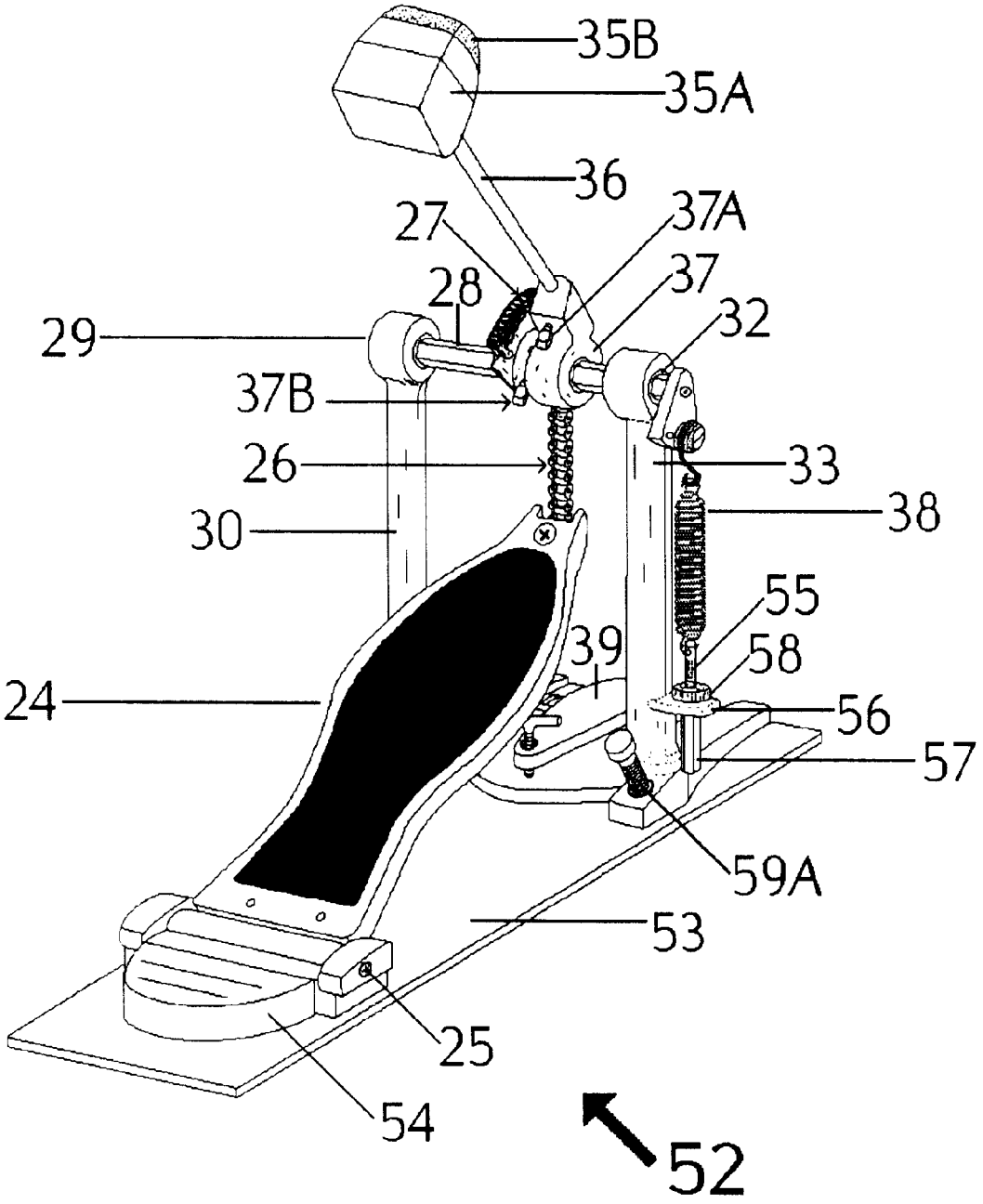
FIG. 8 shows, in perspective, a variant of the conventional mallet driving apparatus which has been adapted for driving pulse generating apparatus.
Figure 9:
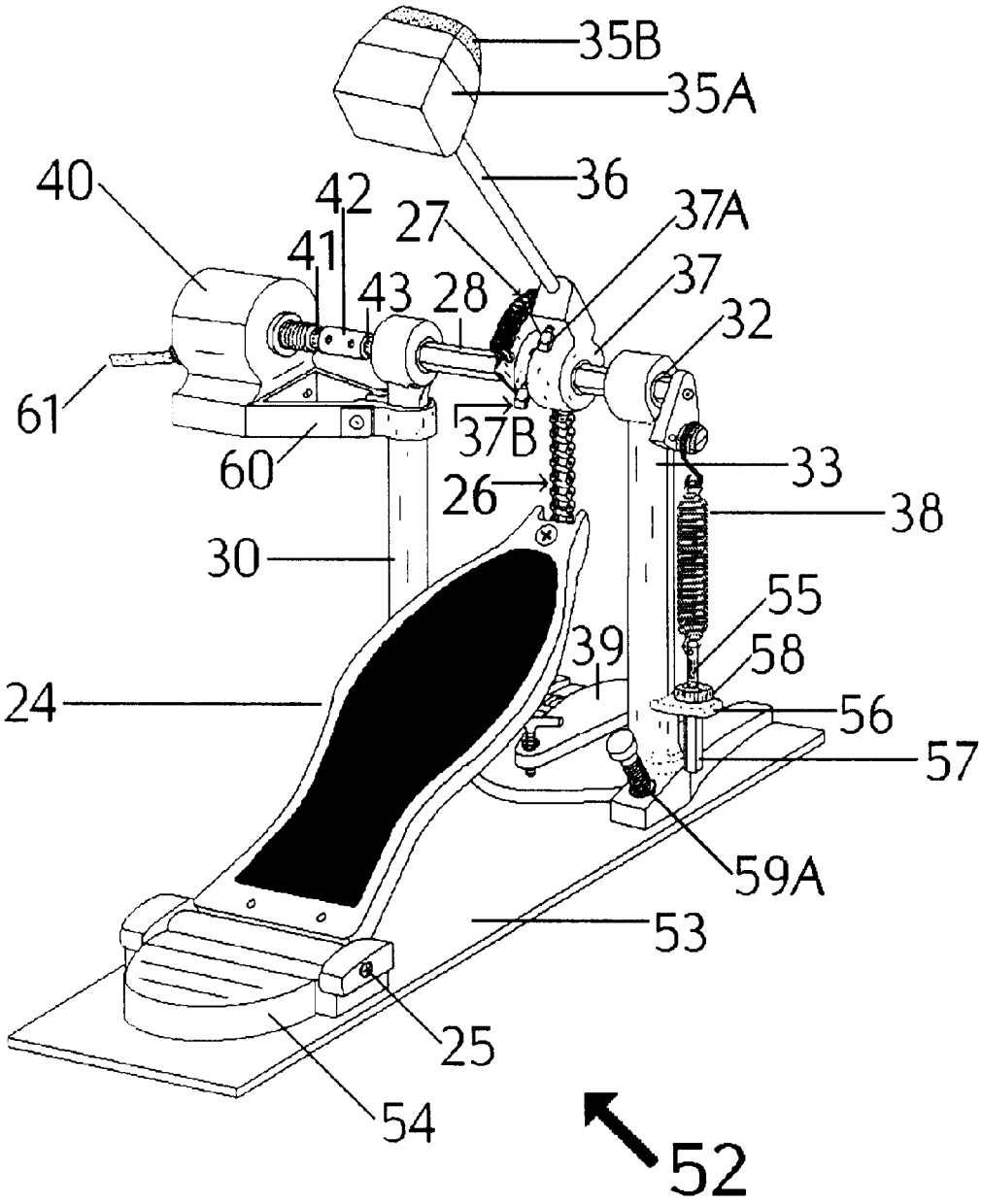
FIG. 9 represents a perspective view of the modified conventional mallet driving system referred to with reference to FIG. 8, which has been modified to allow square wave pulses to be generated by operation of the foot pedal.

With reference to FIG. 9, which represents a perspective view, most of the assembly shown in FIG. 8, is reproduced, but with the exclusion of the mallet and with the addition of the digital potentiometer, 40, already described with reference to FIG. 6.

The digital potentiometer, 40, is supported on the left hand support pillar, 30, of the assembly, 52, by means of a bracket, 60, and its shaft, 41, (see FIG. 6) is connected to the pedal-driven shaft, 43, of the assembly, 52, by means of a coupling 42. A power supply and signal output cable, 61, provides means for connection to the stepper motor drive board, 50 (see FIG. 7).

It can thus be readily seen that downward and upward movement, respectively, of the foot pedal, 24, will give rise to clockwise and counterclockwise rotation, respectively (as viewed along shaft, 43, from the right hand side of FIG. 9) of the shaft, 43, of the foot pedal assembly (an extension of shaft, 28) and hence of the shaft, 41, of the digital potentiometer, 40. This, in turn, will give rise to rotation of the shaft to which the mallet is attached, as already explained with reference to FIG. 6.

This variant of the pedal operated aspect of the invention, demonstrates that conventional, pedal operated mallet driving equipment, can be adapted to drive existing pulse-generating equipment by provision of suitable couplings. Since the conventional part of the apparatus shown in FIG. 9, has a threaded end to the left hand extremity of the mallet driving shaft, an appropriate coupling would have one hollow end, threaded to the same pitch and dimensions, while the other end would allow the shaft, 41, of the digital potentiometer,40, to be locked in place.

It will then only be necessary to remove the mallet from the assembly to retain, for the drummer, the characteristics of a conventional foot pedal assembly, providing the necessary resistance to movement of the foot. The assembly can then be converted back to the original configuration by removal of the digital potentiometer and fitting of the mallet.

Furthermore, the foot pedal assembly described with reference to FIGS. 4, 8, and 9, also provides a convenient framework for mounting a mallet-driving stepper motor, since the assembly already has means for attachment to the bass drum and for fixing to the floor. A variant based on this arrangement is described with reference to FIG. 10.

Figure 10:
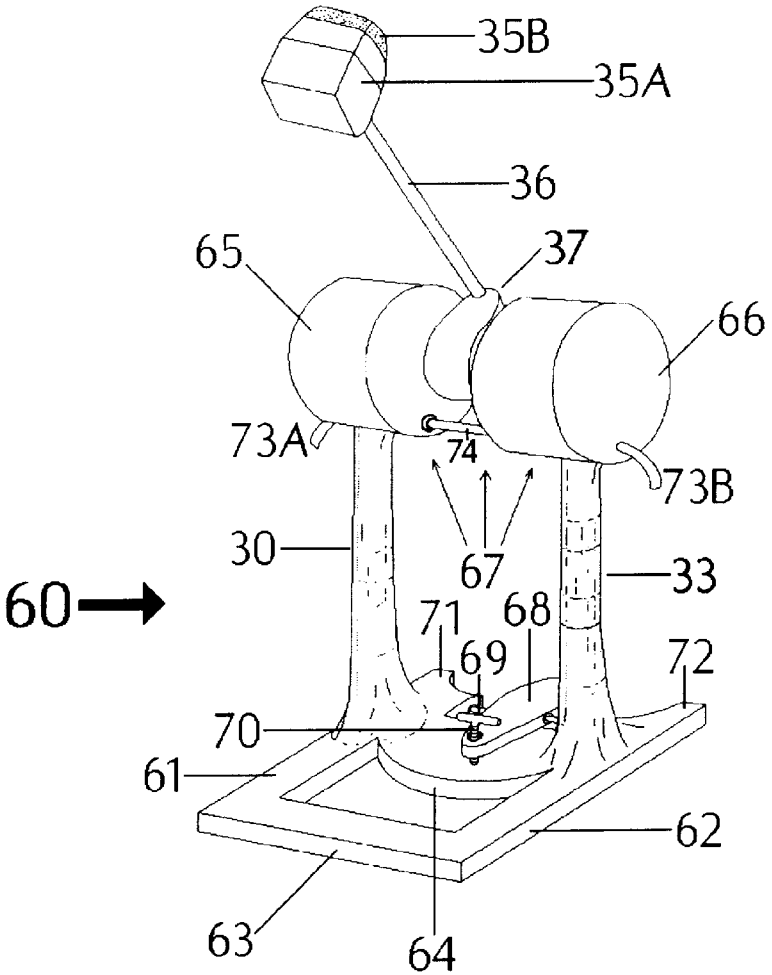
FIG. 10 represents a perspective view of one variant of an electrically operated mallet driving system referred to as the Jet Black Mallet Module.

With reference to FIG. 10, which represents a perspective view, a mallet driver, 60, from hereon referred to as the Jet Black Mallet Driver, is shown. This variant of Jet Black Mallet Driver uses a twin stepper motor, and the elements of the assembly which provide support for the motor, are essentially the same as those already described with reference to FIGS. 4, 8, and 9, with the exclusion of those elements which were connected with the use of the foot pedal. Identifying numbers used with reference to these Figures are therefore retained, where appropriate. Alternatively, the motor could be purely analogue in operation.

Thus, the mallet driver system, 60, consists of a frame, having left and right, side elements, 61 and 62, respectively, a rear element, 63, and a front element, 64. Stepper motor support pillars, 30 and 33, support the left and right parts, 65 and 66, respectively, of a stepper motor assembly, 67, which drives a mallet, 35A/35B, towards and away from, the bass drum head. The mallet is held in a clamp boss, 37, which is itself locked onto the shaft (not shown) of the stepper motor assembly, 67.

Left and right extensions, (not shown) of the shaft of the motor assembly, 67, allow for additional mallets to be driven and/or allow optical shaft encoders to be fitted so that, together with appropriate circuitry, feedback information about the position of the mallet(s) can be provided.

A bass-drum-rim-clamp assembly, has an upper part, 68, which can be moved up and down about an axle, 69, by means of an adjusting screw, 70, so that the rim of the bass drum can be sandwiched between left and right extensions, 71 and 72, respectively, of the front element, 64, of the frame of the assembly and the part 68. Other screws (not shown) allow the frame to be anchored to the floor, if necessary.

Left and right supply cables, 73A and 73B respectively, provide power, and other connections for the two motor halves, and these can, alternatively, be routed through the hollow left, and right, support pillars, 30 and 33, respectively and left and right base elements, 61 and 62, respectively, so that power cabling protrudes from either the left or right element of the base part of the frame, with due attention being paid to safety, and convenience of attachment. There could also be a cable link, 74, between the two motor halves, so that the power cable then needs only to be routed via one support pillar and base element.

Now that the equipment demonstrating the principles of the invention has been described, it is pertinent to introduce a specific variant of the foot pedal, called the Jet Black Bass Drum Pedal, which allows the drummer to use an up-down action of the foot, instead of the usual heel pivotal action found with conventional bass drum pedals.

Figure 11A:
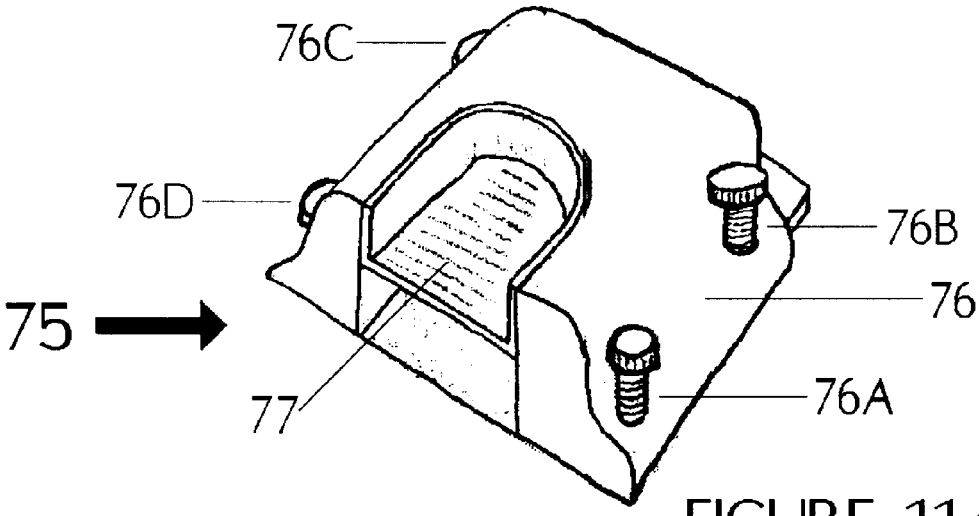
FIG. 11A represents a perspective view of one variant of the Jet Black Footplate Module having one footplate.

Thus, with reference to FIG. 11A, which represents a perspective view, the Jet Black Bass Drum Pedal, 75, has a main body, 76, within which there is a footplate, 77, which, can be pushed downwards by the foot of the drummer and which returns to its upper, rest position, under the restoring action of a spring mechanism (not shown). Internal gearing to a rack and pinion system, or to levers and shafts, allows this up and down motion of the footplate, 77, to rotate e.g. the shaft of a digital potentiometer similar to that, 40, already described with reference to FIGS. 6 and 9, or to rotate the shaft of an optical shaft encoder. Alternatively, a push-rod operated digital potentiometer, or encoder, commonly known as a linear position sensor, having its own return spring, could be placed under the footplate, 77, and operated directly by it. Methods for operating a bass drum which are based on the use of such linear position sensors, are explained later.

Spring-enclosed-spikes, 76A, 76B, 76C, and 76D, allow the Jet Black Bass Drum Pedal, 75, to be anchored to the floor, and, in variants of the design of the pedal, means of lateral and depth wise adjustment, allow the width and depth of the footplate, 77, to be adjusted in order to allow for different sizes of foot to be accommodated. Adjusting screws, mechanisms, etc., allow the resistance presented to the foot of the drummer by the equipment, to be adjusted. In a simpler design, the footplate, 77, is wide and deep enough, to accommodate the largest foot likely to be encountered.

Figure 11B:
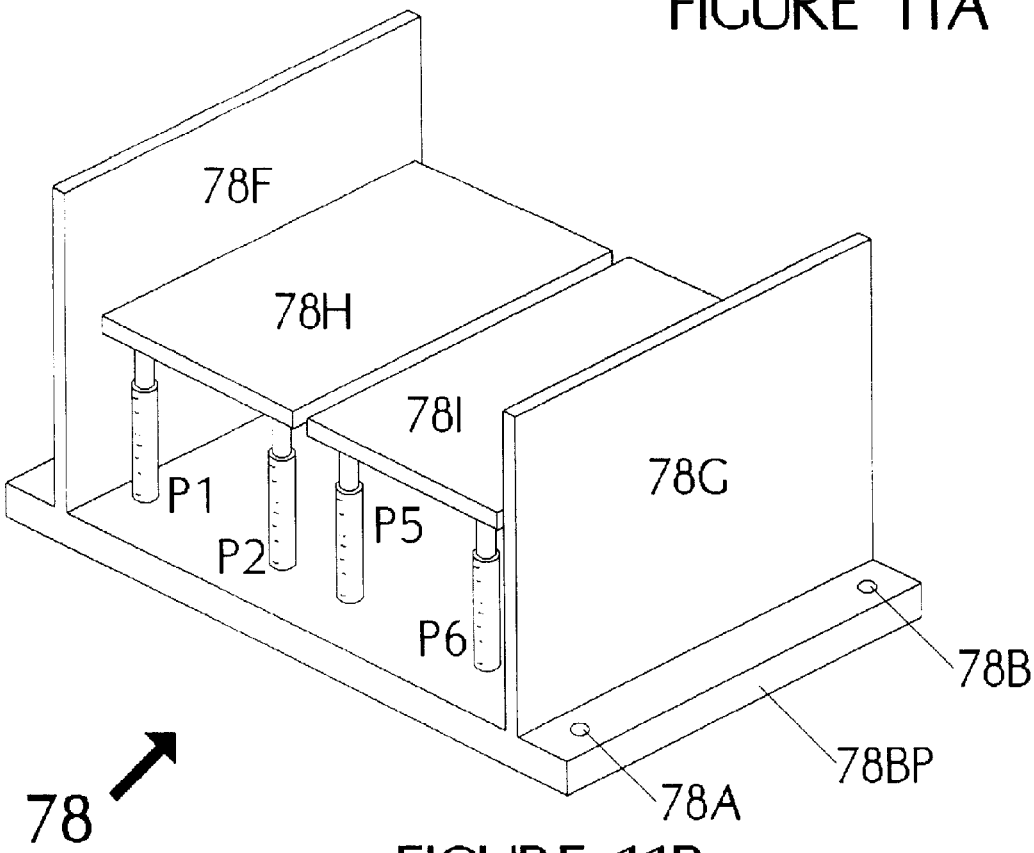
FIG. 11B represents a perspective view of one variant of the Jet Black Footplate Module having two footplates.

With reference to FIG. 11B, which represents a perspective view, a variant, 78, of the Jet Black Bass Drum Pedal, has two independent footplates 78H (left) and 78I (right). Footplate, 78H, is supported on four telescopic spring-loaded legs, P1, P2, and P3, P4 (neither latter shown) and footplate, 781, is supported on four identical legs, P5, P6, and P7, P8 (neither latter shown). The telescopic legs are mounted on a base plate, 78BP, which has vertical side plates, 78F (left) and 78G (right) and the base plate, 78BP, has holes, 78A, 78B, and 78C, 78D (neither latter shown) for attachment of the pedal assembly by means of screws, etc., to the floor, etc.

Other variants of the Jet Black Bass Drum Pedal contain multiple footplates which, via intermediate parts of the associated mechanism, each drive at least one bass drum mallet, such that the drummer can operate any of the separate pedal mechanisms by means of either foot or, due to the arrangement of the footplates, which are either in a side-by-side, or one-above-the-other, single or multiple banked, configuration, either of which configuration is adapted so that the pedals can be temporarily locked to one another in groups of at least two, the user can operate two or more pedals with either foot.

Figure 12:
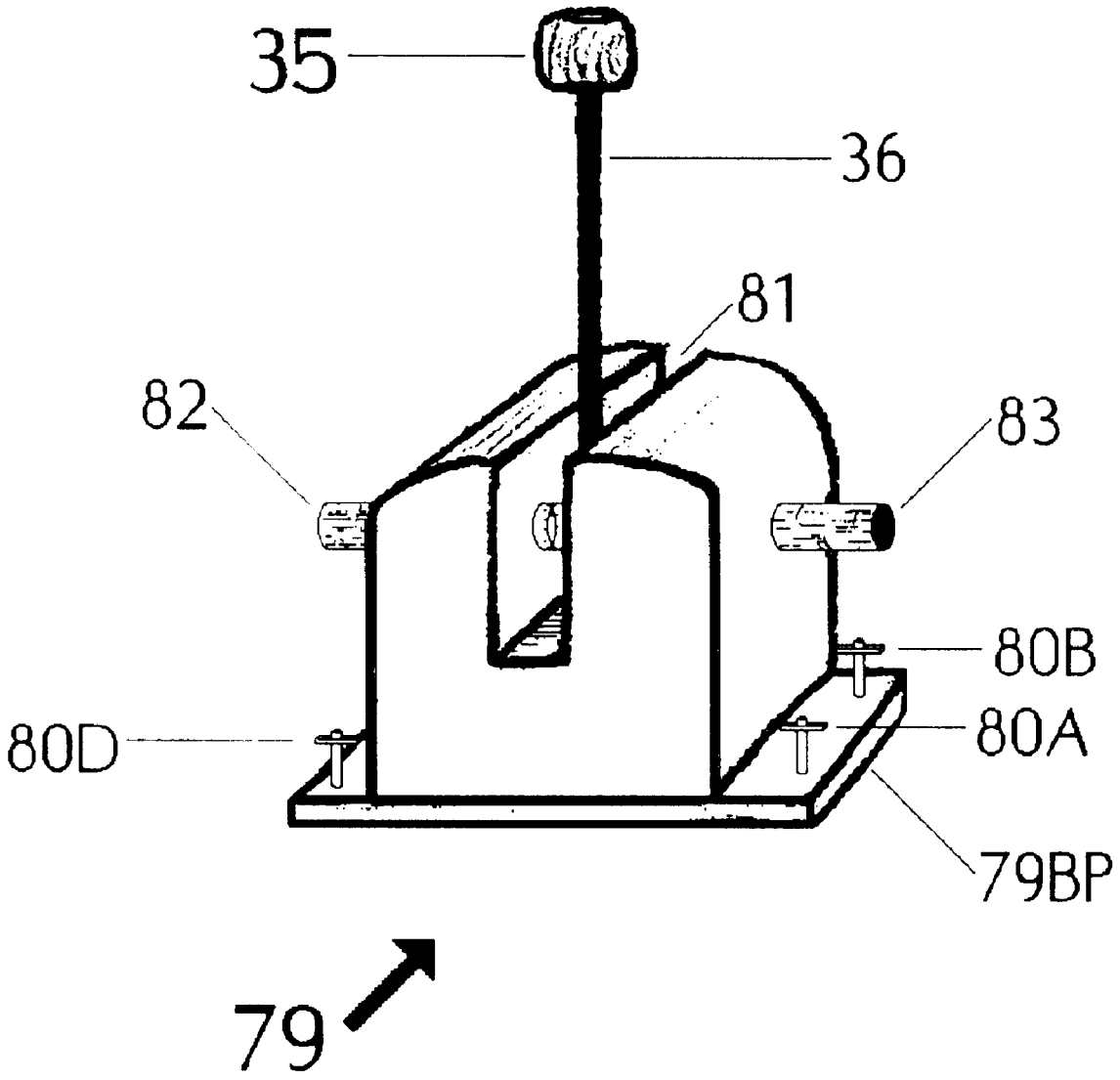
FIG. 12 represents a perspective view of another variant of the Jet Black Mallet Module.

With reference to FIG. 12, which represents a perspective view, a variant, 79, of the Jet Black Mallet Driver, contains a stepper motor housed in an enclosed curved frame having a base-plate, 79BP, provided with anchoring screws, 80A, 80B, 80C (not shown) and 80D. The front part of the assembly, 79, has means for attachment (not shown) to the rim of a bass drum which are similar to that comprising elements, 68, 69, 70, and 71 and 72, already described with reference to FIG. 10. The motor drives a removable and adjustable, mallet, having shaft, 36, and beater, 35.

The central opening, 81, allows, i) the mallet to be clamped to the shaft of the motor, ii) free movement of the mallet, and iii) adjustment of the length of the mallet shaft which extends from the motor shaft.

The shaft of the stepper motor protrudes from each end of the assembly such that, either one, or two, digital potentiometers or optical shaft encoders, or one of each, can be mounted on the extensions, 82, left and 83, right, of the shaft, in order to provide feedback about the position of the shaft of the motor. This allows the position of the mallet, 36, to be computed by use of appropriate electronic circuitry.

Figure 13:
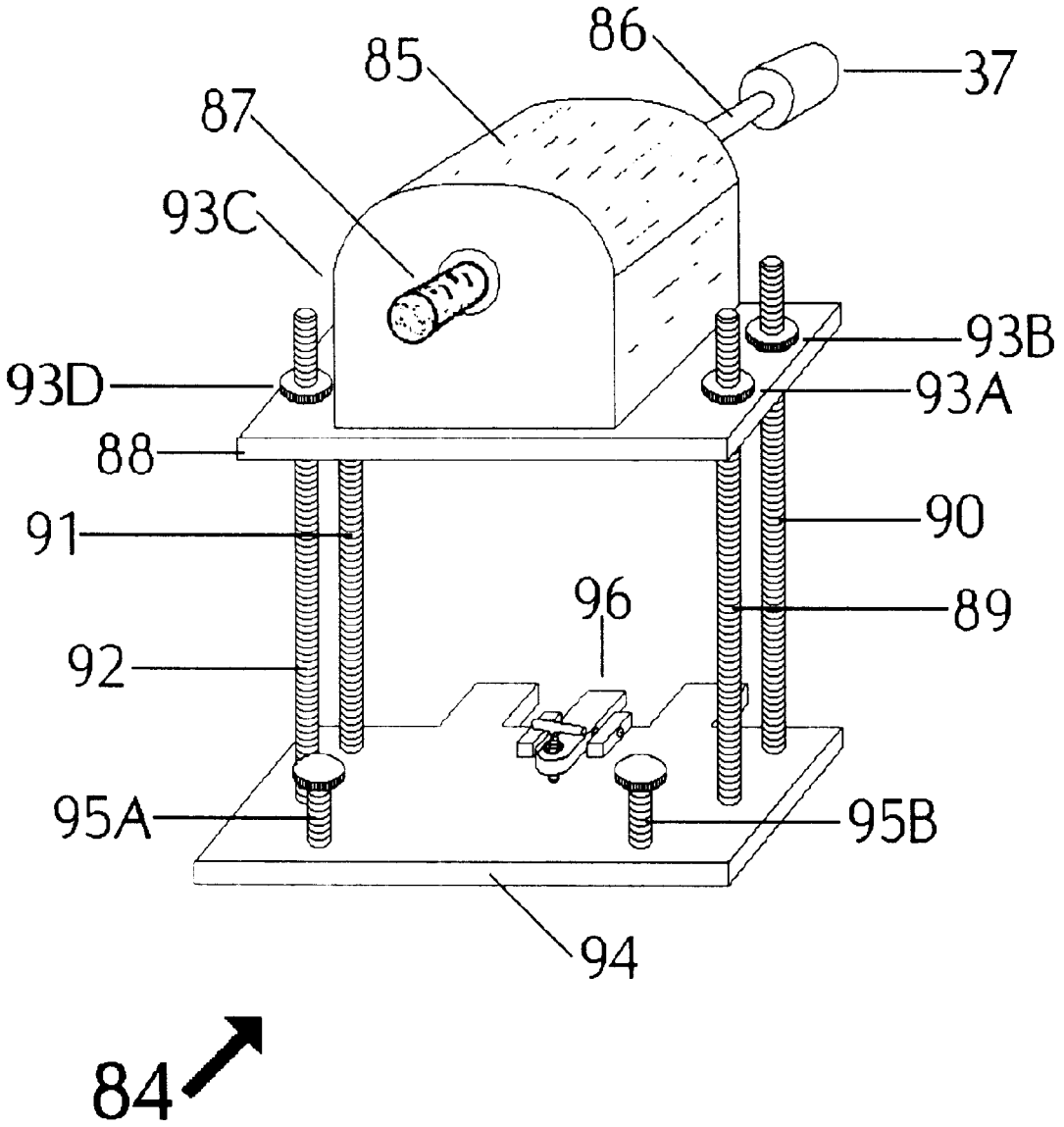
FIG. 13 represents a perspective view of a further variant of the Jet Black Mallet Module, based on linear actuation of the mallet shaft.

With reference to FIG. 13, which represents a perspective view, a variant, 84, of the Jet Black Mallet Driver, which utilizes linear, backwards and forwards movement of the mallet, like a battering ram, is shown. Various well established methods are available for obtaining linear motion of a shaft, but a new way is to provide a linear stepping action, similar to that achieved for rotated stepper motors. This requires special arrangement of the windings of the "linear stepper motor" so that the moving part of the assembly is appropriately designed to take up positions along a linear path towards, and way from, the bass drum head, when appropriate poles of the stator of the assembly are activated.

Thus, the Jet Black Mallet Driver, 84, has a linear motor, 85, provided with a shaft which protrudes from the motor as a front element, 86 and a rear element 87. The motor, 85, either forms an integral part of, or rests on, a platform, 88, which in supported on four threaded legs, 89, 90, 91 and 92, which have knurled clamping nuts, 93A, 93B, 93C (not shown) and 93D, above, and similar nuts below (only the upper ones are shown) platform, 88, for clamping the platform at variable heights above the base-plate, 94. The base-plate, 94, can be screwed to the floor by means of screws, 95A and 95B, and a clamping arrangement, 96, similar to that, having elements, 68, 69, 70, 71 and 72, already described with reference to FIGS. 10 and 12, allows the driver, 84 to be attached to the rim of a bass drum.

Figure 14:
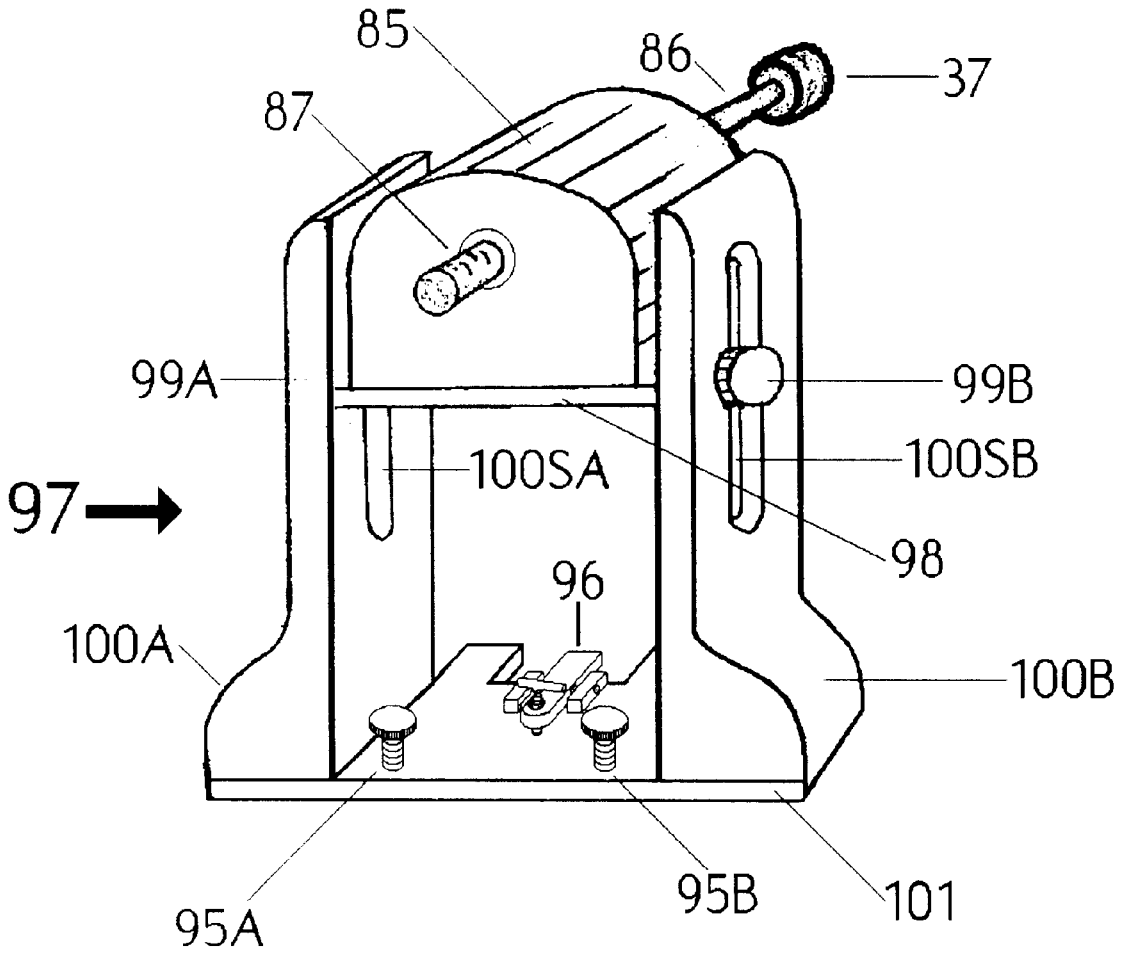
FIG. 14 represents a perspective view of a yet further variant of the Jet Black Mallet Module, based on linear actuation of the mallet shaft.

With reference to FIG. 14, which represents a perspective view, a variant of the means of mounting the linear stepper motor system shown in FIG. 13, is represented as assembly, 97, having alternative means for adjusting the height of the shaft, 86, in relation to the ground. For convenience in the description, those elements of FIG. 13, which occur in FIG. 14, are not described.

Thus, the mo-tor assembly, 85, rests on, or is an integral part of, a platform, 98, which is supported by means of clamping screws, 99A, left, (not shown) and 99B, right, and which can be moved up and down in slots, 100SA and 100SB, in left and right, side pieces, 100A and 100B, respectively, which are bolted to, or form an integral part of, a lower platform, 101.

It is pointed out, with reference to the foregoing account, that the two motors described with reference to FIGS. 13 and 14 could be linear induction motors and these could be operated by appropriate drive circuitry similar to that to be described later.

Now that the various alternative elements of one major variant of the invention have been described, it is expedient to show how the electrical supply to a number of remote bass drum systems is distributed.

Figure 15:
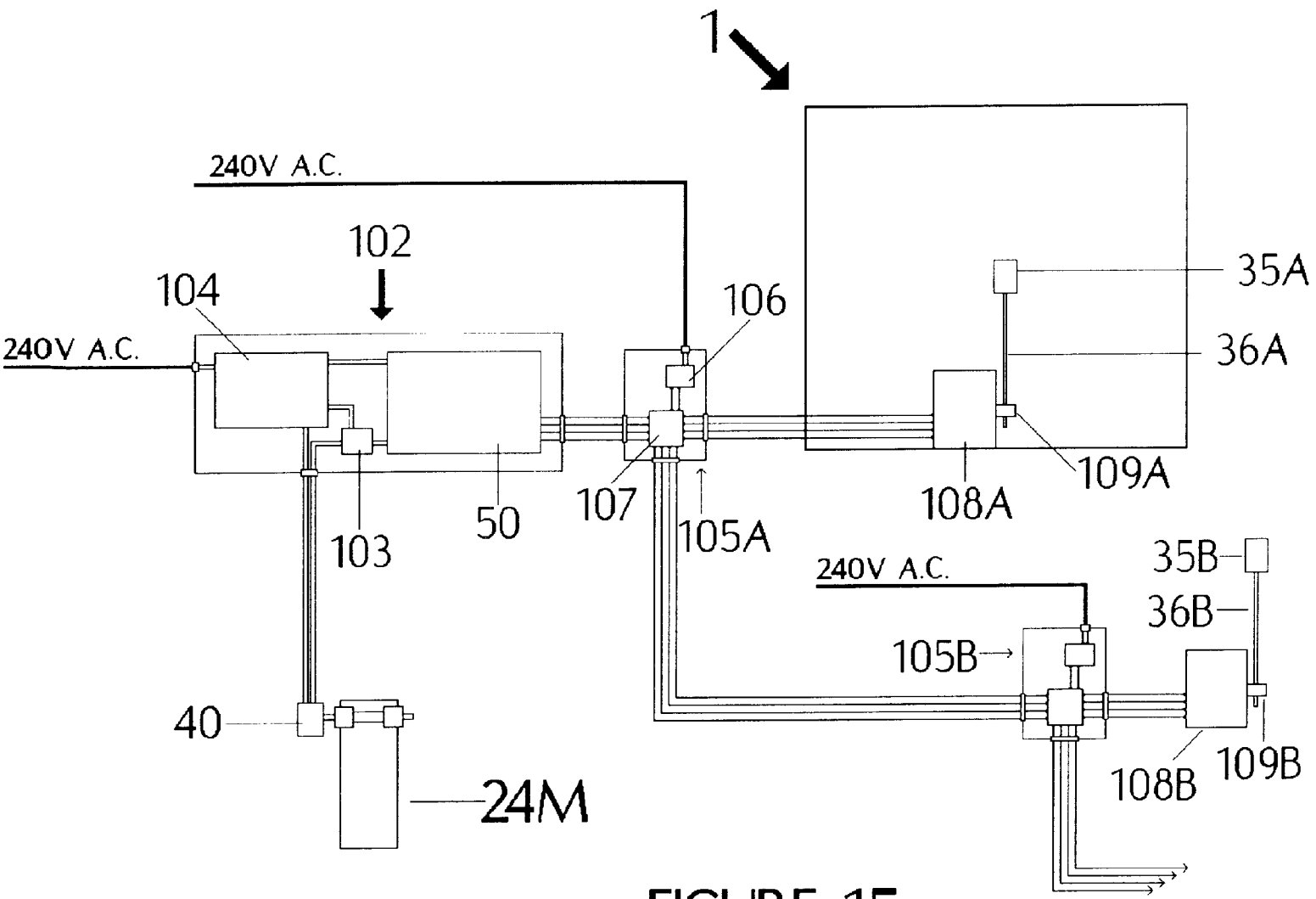
FIG. 15 represents, in a schematic form, one arrangement of the various components used for driving a number of Mallet Modules from one Footplate Module.

Thus, with reference to the schematic diagram shown in FIG. 15, which contains a mixture of plan views and side-, front-, elevations, of the various components, and which is not to scale, a Jet Black Footplate Module, 24M, drives a digital potentiometer, 40, which supplies square wave pulses to a Jet Black Drive Module, 102. This contains interfacing logic circuitry, 103 (already described with reference to FIG. 6) a stepper motor drive board, 50 (already described with reference to FIG. 7) and a power supply unit, 104. The module, 102, is provided with 240V A.C. from the mains supply.

The power supply unit, 104, provides a TTL, 5 Volt supply, for the digital potentiometer, 40, and also for the interfacing logic circuitry, 103, and 15–30 Volts d.c. for the drive board, 50.

The combination of Jet Black Footplate Module, 24M, and Jet Black Drive Module, 102, can be used to drive one Mallet Module, 60 (FIG. 10) or 79 (FIG. 12) provided that there is enough power available from the drive board, 50.

Where more power is required, or where more than one Mallet Module is to be driven from one Footplate Module, 24M, a Power Module, 105A, provided with 240V A.C. from the mains supply, provides the necessary power.

The Power Module, 105A, contains a power supply unit, 106, which provides a 5 Volt TTL supply to interfacing logic and other circuitry and switchable power to a switching unit, 107. Unit, 107, functions by allowing the drive voltages from the drive board, 50, to switch relays, transistors, etc., on and off, so that these devices can switch on and off, the power required by the Mallet Module, 108A, with the necessary power derived from the mains supply.

The Mallet Module, 108A, is shown situated in front of the bass drum, 1, and has a motor shaft, 109A, fitted with mallet, 35A, attached to a mallet shaft, 36A.

The switching unit, 107, contains opto-isolators (e.g. RS Stock Number 110-208) and other interfacing circuitry, which provide a faithful repetition of the original drive voltages from the drive board, 50, to be supplied to the next Power Module, 105B, which provides power for the next Mallet Module, 108B.

One additional new feature which can be incorporated into the equipment, is a delay box. Thus, a programmable delay box (not shown) containing delay timing circuitry, can be placed in series with the drive from the first Power Module, 105A and the next Power Module, 105B, and so on, between each of the additional modules, so that each mallet beat is delayed by any desired time, from fractions of a second to full seconds, etc. Apart from adding to the flexibility of the system, it could also offer means for compensating for echo effects which could result from the different geographical locations of the various bass drums in use, although it is appreciated that more complicated arrangements may be necessary in order to achieve this.

Through these means, therefore, a relatively low power capability is required from the drive board, 50, and the Power Modules, 105A and 105B etc., can be chained to one another.

It is, of course, also possible to drive a number of Mallet Modules, 108A, 108B, etc., from one Power Module, 105A, by designing the Power Module so that it, alone, can supply sufficient power (i.e. current, for a given stepper motor voltage) to the required number of Mallet Modules. The unit would be designed so that it had the desired number of parallel output ports, implemented in the form of female sockets, for safety reasons. Special Power Modules could be designed to cater for these requirements. Alternatively, or additionally, the equipment could be designed so that such parallel connection was implemented by plugging the second switching unit into the first, in a chaining fashion.

It is pointed out that the equipment should be designed so that the motor can be easily replaced if it burns out, etc., and that, because of the harsh environment/treatment encountered by modern musical equipment, special attention should be paid to the design of the wiring to it.

It is pointed out that, in the foregoing and following text, all equipment should be adequately fused and protected, for maximum simplicity (e.g. troubleshooting) and safety, in use. The equipment would, ideally, be designed so that, if one or more parts fail(s), the drummer is warned of this, and also so that the remainder continues to function.

With reference to the foregoing, it is pointed out that a diversity of electronic routes to implementation of the requirements of the drummer is possible.

It is also pointed out, with reference to the foregoing, that transducers or any other devices capable of providing information about the force applied by the mallet, the sound level, or other information, could be incorporated into the equipment described.

It is further pointed rut, that due consideration be given to the safety of the equipment both with regard to prevention of unintentional operation of the stepper motor(s) whenever the equipment is connected to the power supply, and also with regard to general electrical safety, in connection with the standard of wiring and its paths. Ideally, appropriate plug and socket arrangements would be implemented and the system would be configured so as to maximize the efficiency of the wiring layout.

Also, adequate protection should be provided by means of circuit breakers and fuses. The whole system would also usefully be designed so as to allow easy replacement of component parts so that the whole system does not have to be exchanged if one part becomes faulty.

The major part of the description of the electrical system which has been given in the foregoing account has been concerned with the use of stepper motors, and the implementation of the principles of the invention by means of servo-control has been only briefly described earlier. Servo-control will now be described in detail.

Figure 16B:
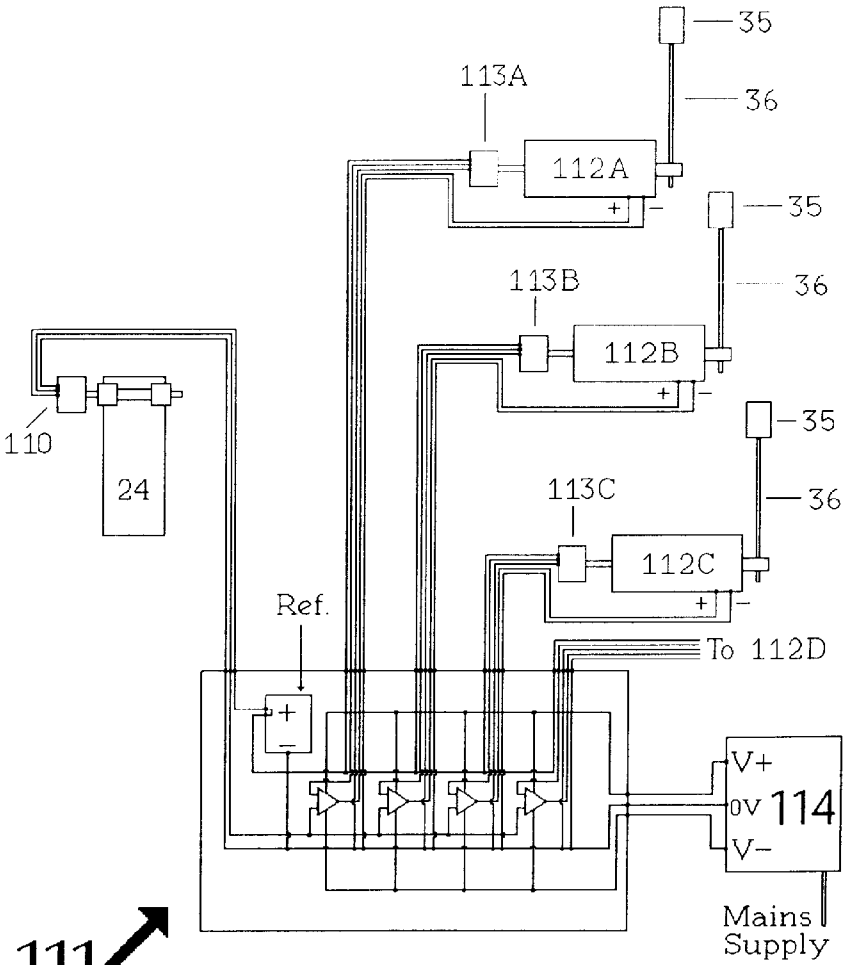
FIG. 16B represents, in schematic form, the functional components of an arrangement for driving more than one Mallet Module from one Footplate Module.
Figure 16A:
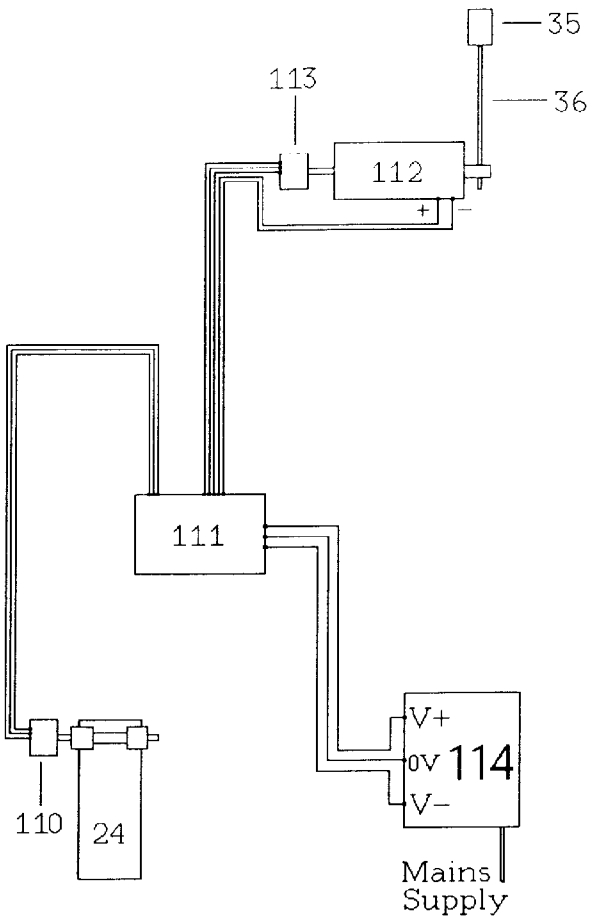
FIG. 16A represents, in schematic form, the functional components of a further arrangement for implementing the principles of the invention via Footplate, and Mallet Modules.

With reference to the schematic diagram shown in FIG. 16A, a foot pedal, 24, drives an analogue, pedal potentiometer, 10, which is shown as shaft mounted and therefore rotary in operation, but could be linear if placed under the foot pedal, 24. Such potentiometers are referred to as Rotary, or Linear, Position Sensors. This is similar to the arrangement involving Jet Black Footplate Module, 24M, and digital potentiometer, 40, already referred to with reference to FIG. 15 and which is shown in perspective in FIG. 9.

When the drummer pushes the foot pedal, 24, downwards, the potentiometer, 110, provides, via control unit, 111, an "out-of-balance" voltage to mallet-driving, electric motor, 112, and this causes the mallet shaft, 36, attached to the motor shaft, to rotate towards the bass drum head. The motor has its own analogue potentiometer, 113 (commonly referred to as a slave potentiometer) whose output voltage is compared with that from the pedal potentiometer, 110, by means of circuitry within the control unit, 111. A trip e-rail d.c. power supply unit, 114, connected to the Mains Supply (or otherwise supplied from a generator or battery pack) provides the required voltages to the control unit, 111.

When the output from the mallet potentiometer, 113, is equal to that from the pedal potentiometer, 110, the control circuitry no longer provides a voltage output for driving the motor, 112, and hence the mallet attached to its shaft remains stationary. Each movement of the foot pedal, 24, thus gives rise to a corresponding movement of the mallet attached to the shaft of motor, 112. When the drummer lifts his foot from the foot pedal, the system is out-of-balance again but this time the output from the controller, 111, drives the motor, 112, in the opposite direction, so that the mallet moves away from the bass drum head.

By these means, therefore, the drummer is able to cause the mallet to beat against the bass drum head in direct response to the movement of the foot pedal.

With reference to the schematic diagram shown in FIG. 16B, which contains elements of FIG. 16A, some detail of the contents of control unit, 111, is shown, together with three mallet drive units, 112A, 112B and 112C, which can be driven by means of foot pedal, 24. The diagram is intended to show how more than one mallet drive unit can be operated by one foot pedal assembly, 24, and those mallet drive units beyond three are represented by the drive to 112D, which latter is not shown.

Control unit, 111, is shown containing four operational amplifiers (see below) with the first three connected, both to the potentiometers, 113A, 113B and 113C, mounted on the drive shafts of motors, 112A, 112B, and 112C, respectively (which are identical with motor, 112, shown in FIG. 16A) and to the motors themselves, and where the last is shown intended to be connected to motor, 112D and its associated potentiometer (neither shown). Control unit, 111, also contains a d.c. Reference Voltage source, labeled, Ref.

It can thus be readily seen that any number of mallet drive assemblies like 112, can be driven by one foot pedal assembly, 24, via control unit, 111, provided that unit, 111, has the required number of operational amplifiers and is designed to be able to handle the power requirements of the total number of mallet drive units. Individual integrated circuits are available which contain more than one functional circuit, so the operational amplifiers shown in FIG. 16B could well be provided as a block of four, in one integrated circuit; a number of such integrated circuits could thus be mounted on a circuit board within control unit, 111.

Equipment can be simplified by relying on just one mallet driving assembly having a shaft mounted potentiometer, while the remaining mallets are driven by motors which have their armatures connected in parallel with the drive to this assembly.

The "at rest" and "in contact with the drum head" positions of the mallets attached to each motor, would then be adjustable by means of balance potentiometers (see later) connected to the pedal potentiometer, 110, and if desired, adjustable mechanical links at each mallet drive assembly.

An explanation of the circuitry referred to, with reference to FIGS. 16A and 16B, is given in the description made later, with reference to FIGS. 18 and 19.

Figures 17A, 17B, 17C:
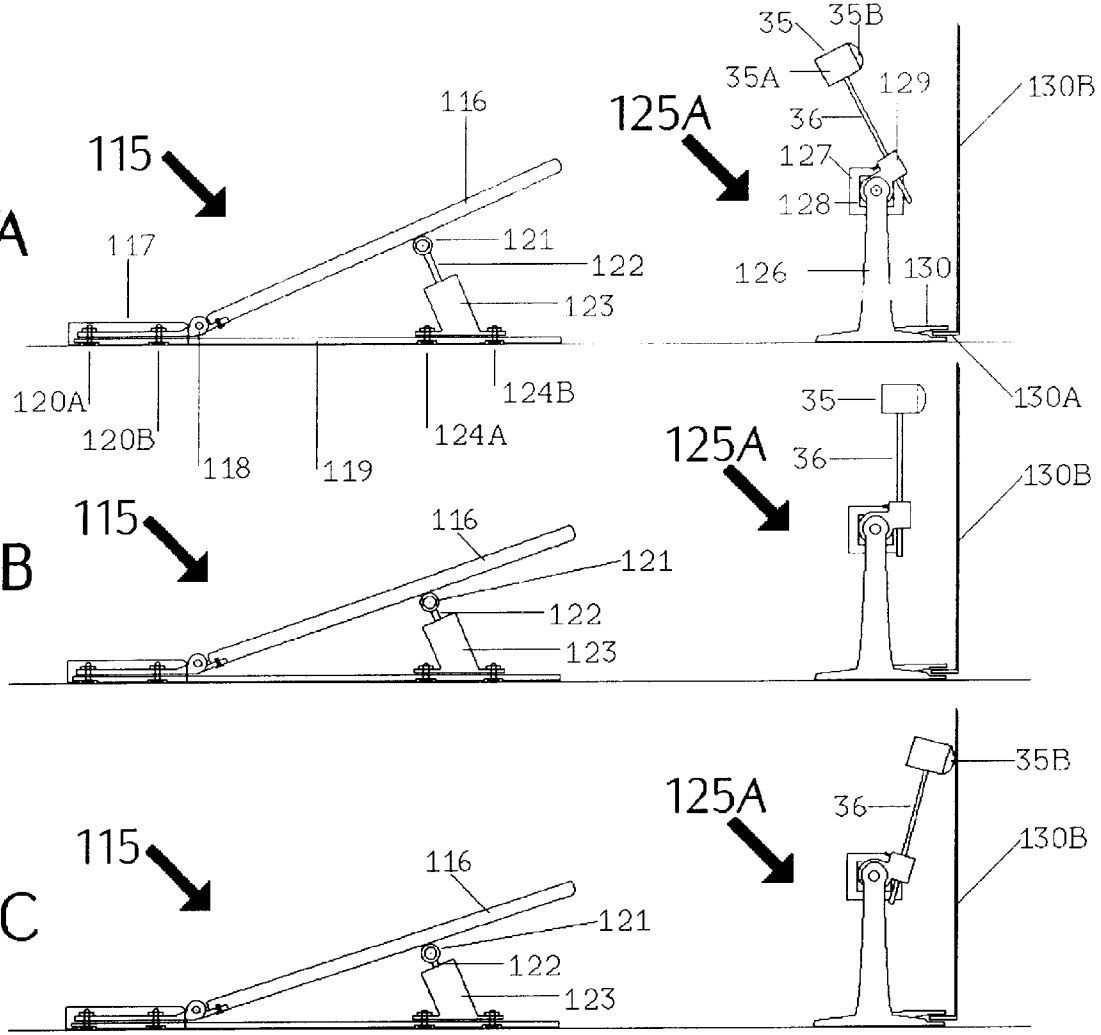
FIG. 17A shows a side elevation of a foot pedal assembly and mallet assembly which are used in the implementation of the principles of the invention. The assemblies are shown in their standby positions.
FIG. 17B shows a side elevation of the same assemblies as shown in FIG. 17A but with the assemblies in their intermediate positions.
FIG. 17C shows a side elevation of the assemblies shown in FIG. 17A but with the assemblies shown in their final positions.
Figure 18:
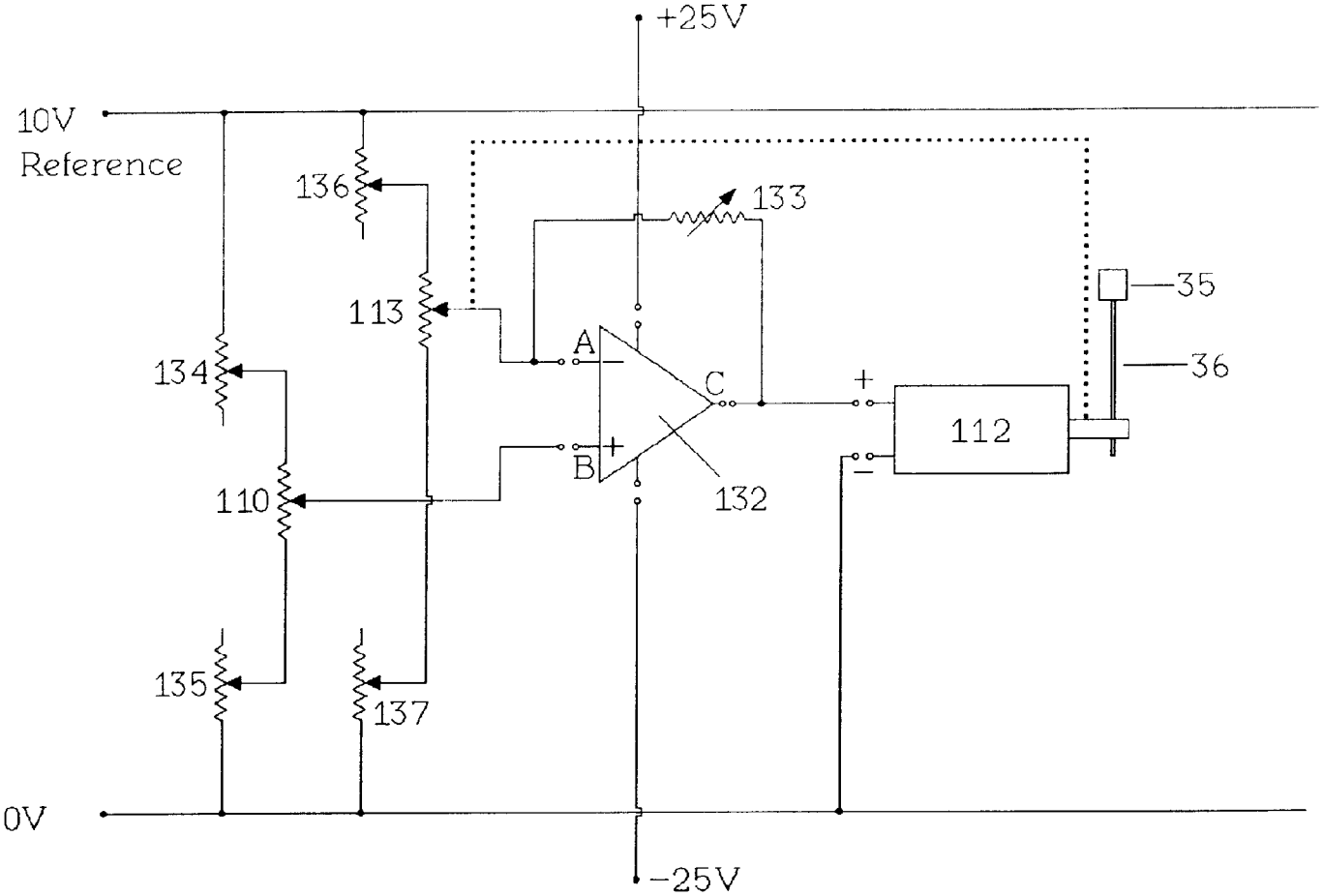
FIG. 18 shows a schematic representation of circuitry utilized in the equipment shown in FIGS. 16A and 16B.
Figure 19:
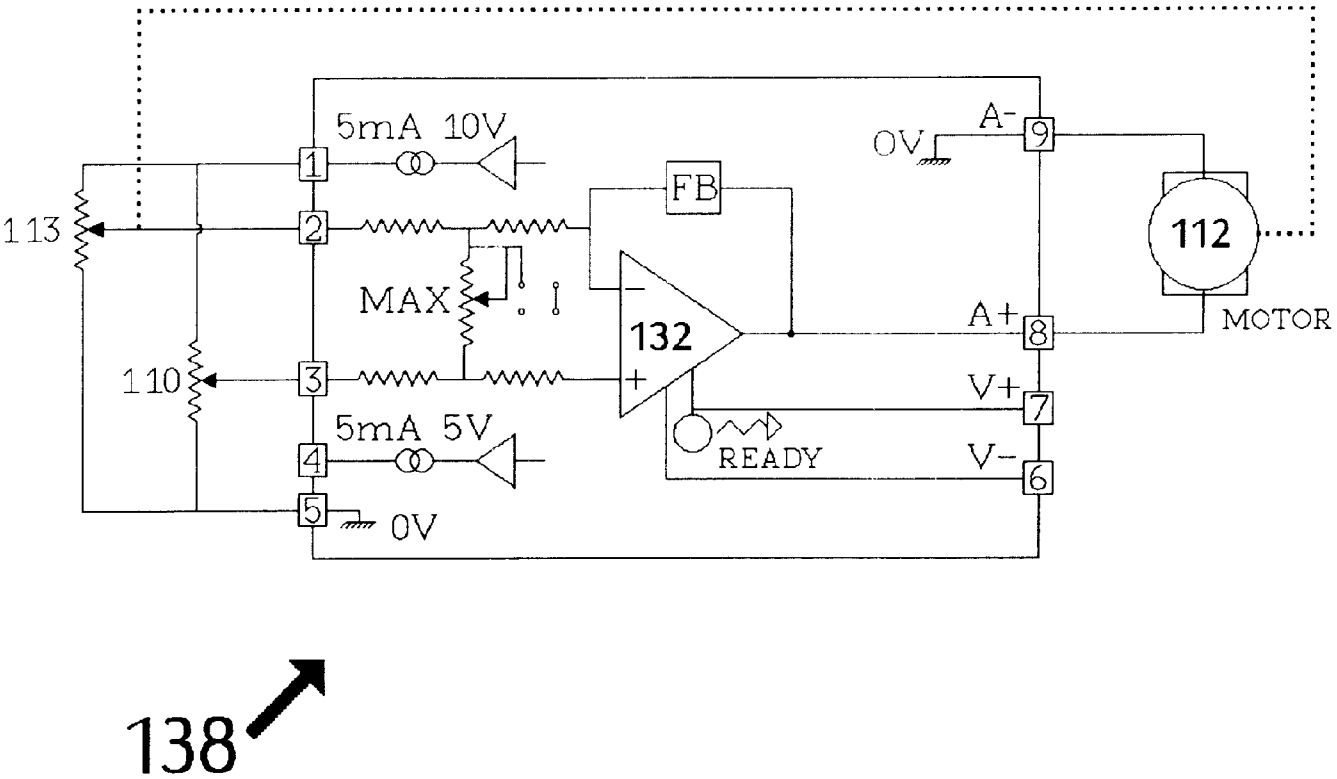
FIG. 19 shows a schematic representation of the functional layout of electronic equipment utilized for implementing the principles of the invention via the apparatus described with reference to FIGS. 17A, 17B and 17C.
Figure 20:
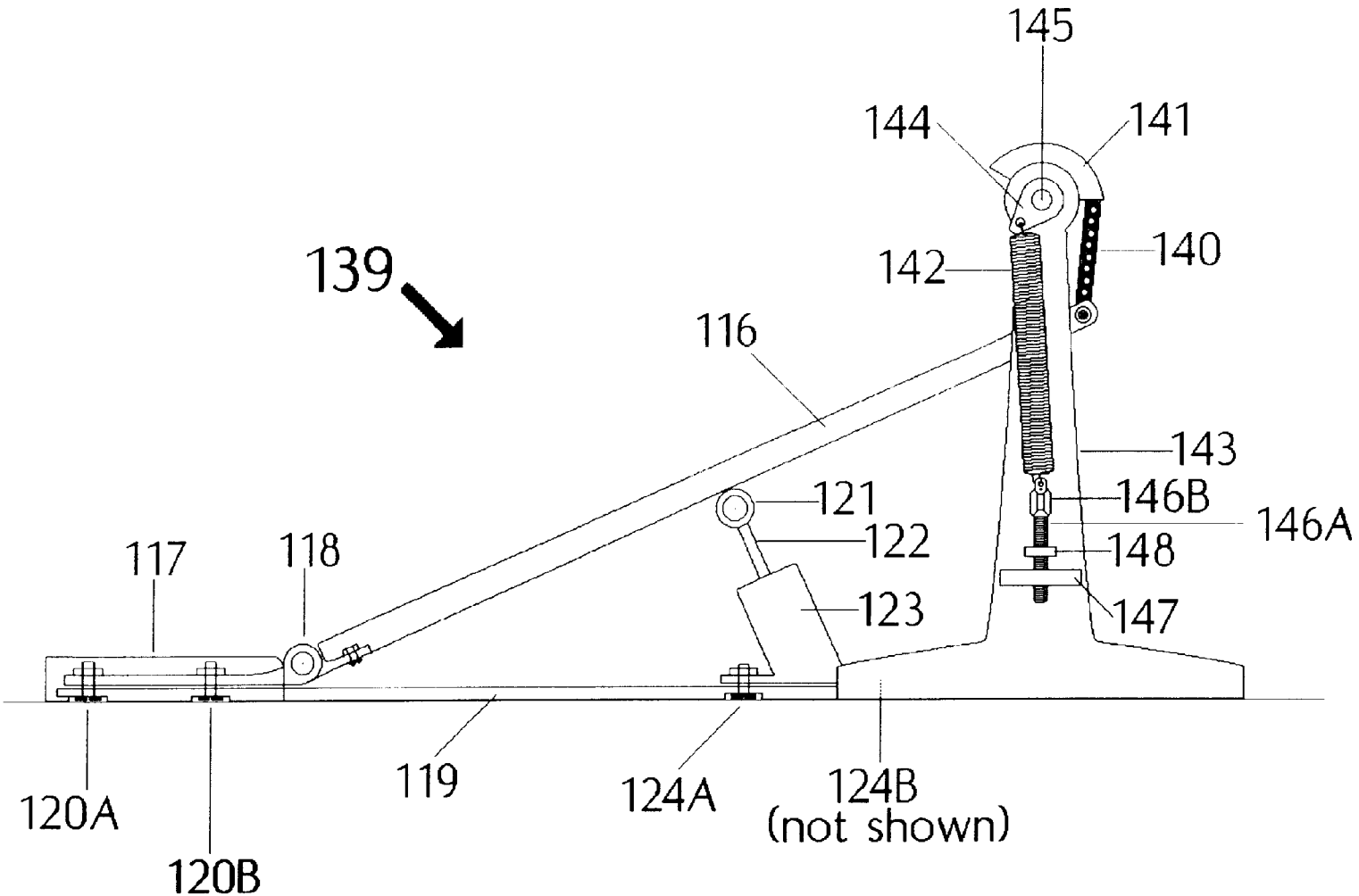
FIG. 20 shows, in side elevation, a foot pedal assembly which provides an electrical output for operating a motor driven mallet assembly based on the principles of the invention.
Figure 21B:
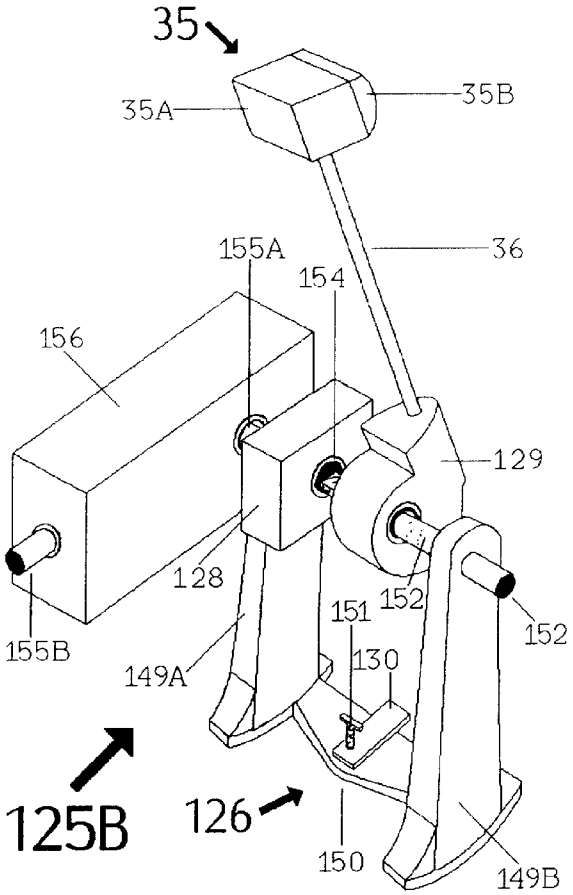
FIG. 21B shows in perspective, a further motor driven mallet assembly.
Figure 21A:
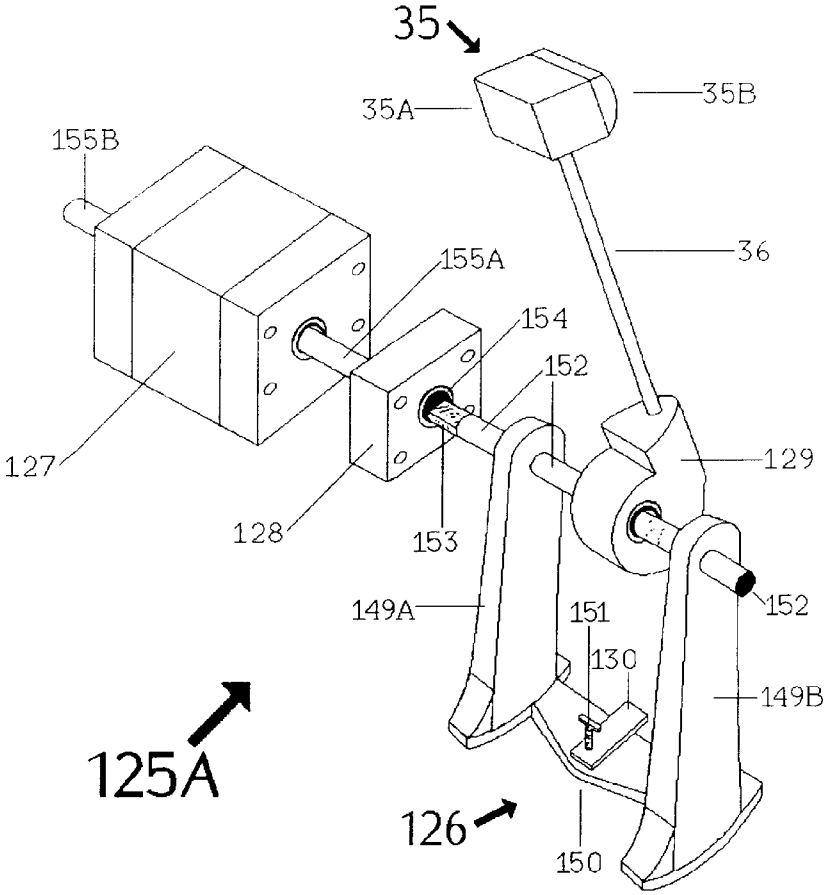
FIG. 21A shows, in perspective, a motor driven mallet assembly.

Equipment which allows this function to be implemented is shown in three stages of operation in FIGS. 17A, 17B and 17C, and the corresponding circuitry, already referred to with reference to FIGS. 16A and 16B, is shown in FIGS. 18, and 19. FIGS. 20, 21A, and 21B, show more detailed views of the equipment.

With reference to FIGS. 17A, 17B and 17C, which represent side elevations, these show, respectively, standby, intermediate and final, positions of the foot pedal, and corresponding positions of the mallet. It is to be noted that the pedal shown in FIGS. 16A and 16B involves the use of a rotary potentiometer, while FIGS. 17A, 17B and 17C involve the use of a linear potentiometer.

Furthermore, for convenience in drawing the diagrams, the respective elements of the various assemblies to be described, are assumed to be the same in all three Figures and therefore, only some parts are identified again in FIGS. 17B and 17C.

With reference to FIG. 17A, a foot pedal assembly, 115, has a footplate, 116, and a heel plate, 117, connected by means of a hinge, 118. The heel plate, 117, is bolted to a base plate, 119, by means of nuts and bolts, 120A and 120B. The underside of the footplate, 116, engages with the rolling tip, 121, of the shaft, 122, of a linear potentiometer, 123, which is bolted to the base plate, 119, by means of nuts and bolts, 124A and 124B. The foot pedal, 115, is shown in the position which it assumes when the foot is removed from the pedal.

It is to be noted that, while the linear potentiometer, 123, is provided with its own return spring, this may not supply sufficient force to cause the footplate, 116, to return to the uppermost position with the foot removed from it. Therefore, return springs, which are not shown in FIGS. 17A, 17B and 17C, will be necessary. One variant of the design, which utilizes principles found in conventional foot pedals, is described later with reference to FIG. 20.

To the right hand side of FIG. 17A, a mallet assembly, 125A, has a pedestal, 126, which carries an electric motor, 127, and a rotary potentiometer, 128. The motor, 127, rotates a mallet driving assembly, 129, whose shaft, 36, has, mounted on its end, a mallet, 35, having main body, 35A and felt tip, 35B. The assembly is shown with the mallet in the standby, "ready to strike", position. A clamp, 130, is shown clamping the base of the pedestal, 126, to part of the rim, 130A, of the bass drum, part of the vertical head of which, is shown in side elevation as 130B. With reference to FIG. 17B, it can be seen that the footplate, 116, has been moved downwards and that the shaft, 122, of the linear potentiometer, 123, has moved into the body of the potentiometer. It can also be seen that the mallet shaft, 36, has rotated in a clockwise direction so that the mallet, 35, is now closer to the drum head, 130B.

With reference to FIG. 17C, the footplate is now seen to be in its lowest position and the shaft, 122, can be seen to have moved further into the body of the potentiometer, 123. It can also be seen that the mallet shaft, 36, has rotated further, so that the felt tip, 35B, of the mallet, 35, is now in contact with the surface of the bass drum head, 130B.

With this equipment, we have replaced a system involving direct mechanical linkage between the foot of the drummer and the driven mallet (which provides the drummer with direct feedback; see earlier description of conventional bass drum pedal equipment) with a system in which the foot does not receive any direct feedback about the position of the mallet in relation to the bass drum head surface.

Means are therefore necessary for providing the drummer, at least with means for adjustment of the position of the mallet in relation to the drum head surface, and ideally, with feedback about the position of the mallet in relation to the drum head surface.

One method would involve the use of indicating lamps e.g. light emitting diodes (LEDs) which are activated at particular positions of the mallet. With prior calibration, this would provide the drummer with set points about which to adjust the system, especially when the mallet assembly is remote and when there is more than one such assembly. A further facility in this connection would be to place the LEDs on a diagram representing the path of the mallet from its rest position to the position corresponding with contact of the mallet with the drum head. The diagram could form part of the front surface of a control unit placed within reach of the drummer.

More than one mallet assembly could be monitored by designing the equipment so as to have the appropriate number of diagrams or otherwise by arranging for the position sensing circuitry from each assembly to be selected for display on one diagram.

The LEDs could be switched on via appropriately positioned sensing switches or via circuitry which measures the output from e.g. an encoder mounted on the shaft of the motor driving the bass drum mallet. By these means, therefore, every time the mallet makes contact with the drum head, the drummer will be given a visual warning.

The use of such display techniques gives rise to a whole new range of possibilities for enhancing the performance achieved by the drummer, either by use of existing technology or by the invention of new technology. A further refinement can involve use of a microcomputer with corresponding visual display of the position(s) of mallet(s). A yet further refinement can allow the drummer to operate bass drum mallets by means of a key stroke or by screen selection of various icons e.g. resembling base drums or mallets using touch screen techniques or a mouse, etc.

Apart from mechanical adjustments, the actual position of the mallet, 35, for the extreme positions of the footplate, 116, can be adjusted by means of potentiometers incorporated into the circuitry contained within the control unit, 111, already described with reference to FIGS. 16A and 16B. This facility allows the drummer to set up the equipment for optimum effect.

In order to prevent damage to the linear potentiometer, 123, or any other potentiometer, e.g. a rotary one, limit stops can be incorporated into the design of the foot pedal assembly, 115, and various sensors, used with appropriate electronic circuitry, can be utilized. The display methods referred to above could be used for these purposes.

However, apart from the use of the sound resulting from the impact of the mallet with the drum head surface, which anyway, would be difficult to hear during a live performance unless earphones were used and would also require that the drummer stop pressing the foot down in response to a response, the drummer has no way of knowing that the mallet has hit the surface of the drum head and therefore has to rely on the correct setting up of the equipment and invariance of its performance, together with the methods of indicating where the mallet is, as described above, in order to ensure satisfactory results.

Ideally, when the mallet strikes the drum head, the new foot pedal mechanism should provide the drummer with the same type of resistance to motion of the foot that is found with conventional pedal mechanisms. Thus, provision of an adjustable stop immediately below the footplate, will allow this stop position to be adjusted and the mallet driving equipment to be adjusted accordingly, in a calibration phase, so that this stop position coincides with the striking of the mallet with the drum head. Any new method of providing such resistance will need to be tolerated and assimilated by the drummer.

A further development, which does provide feedback to the drummer, involves provision of a device which produces an adjustable resistance to the movement of the footplate, where such resistance can be arranged to vary with the actual position of the mallet.

Since there will always be flexure of the bass drum head, the mallet can, and needs to, travel further than just to the point of initial contact with the head surface.

As part of the protective procedures utilized in the practical implementation of the invention, micro switches were incorporated into the circuitry so that power to the mallet-driving motor, could be cut off, if, and when, the mallet passed some pre-determined position.

Notwithstanding the possible unacceptability of this, however, the fact that the drummer now has considerably more power available, means that the drum head could be damaged without correct calibration of the equipment or the incorporation of suitable measures to prevent damage. A clutch system might usefully be incorporated.

Other methods for providing the drummer with feedback about the position of the mallet could involve the use of oscilloscope techniques.

With reference to the schematic diagram shown in FIG. 18, the circuitry for implementation of the principles of the invention via servo-control is shown. With the exception of the pedal and mallet potentiometers, 110 and 113, respectively, the circuitry resembles that which is contained within control unit, 111, already described with reference to FIGS. 16A and 16B.

The main functional component of control unit, 111, is an operational amplifier, 132, which has inverting and non-inverting inputs labeled A and B, respectively, and an output, labeled, C. The operational amplifier, 132, is supplied with + and −25 volts, from the triple-rail power supply, 114 (not shown, but see FIGS. 16A and 16B) with the common zero voltage line indicated as OV.

It is to be noted that, for ease of interpretation of the principles of the invention via the diagram, and also since the operating principles of servo-controllers are well established, some operational components have been excluded. These serve such purposes as back e.m.f. protection, filtering and provision of a reference voltage. Also, the potentially high operating temperature of operational amplifier, 132, requires the use of a suitably rated heat sink which is also not shown.

The non-inverting input, B, of the operational amplifier, 132, is supplied with a voltage which is derived from the output of a voltage dividing pedal potentiometer, 110, whose wiper contact is driven indirectly by the foot of the drummer via a direct link between the foot pedal and the shaft of the potentiometer, which can either be rotary or linear. The potentiometer, 110, is itself supplied with a precisely controlled reference voltage of 10 volts (which is derived from a suitable integrated circuit package) at its supply terminals.

The inverting input, A, of the operational amplifier, 132, is supplied with a voltage from the output of a voltage dividing potentiometer, 113, whose wiper contact is driven directly by the motor shaft on which the mallet in mounted. This potentiometer is also connected to the 10 volt reference supply. The mallet shaft is driven by means of a d.c. electric motor, 112, whose positive armature terminal in connected to the output, C, of the operational amplifier, 132, and whose negative terminal is connected to the common zero voltage line, labeled as OV.

The potentiometer, 110, driven by the foot pedal, is known as the pedal potentiometer and the one, 113, driven by the mallet shaft, is known as the mallet potentiometer. Potentiometer, 113, is shown linked to the shaft of motor, 112, by means of a dotted line.

Movement of the pedal potentiometer, 110, thus "taps off" a proportion of the 10 volt reference voltage, and the 10 value of this "tapped off" voltage depends on the position of the foot of the drummer when the foot is pressed down on the footplate, 116, of the pedal assembly, 115, referred to with reference to FIGS. 17A, 17B and 17C. In these Figures, pedal potentiometer, 110, is represented by potentiometer, 123, (which is linear in operation) and mallet potentiometer, 113, is represented by rotary potentiometer, 128. Motor, 112, is represented by motor, 127.

The voltage from the pedal potentiometer, 110, is instantaneously compared with that supplied by the mallet potentiometer, 113, and, with the pedal and mallet at rest, in their standby positions, the two voltages are equal. There is thus no output from the operational amplifier, 132, and the voltage supplied to the positive terminal of the motor is therefore zero. The motor thus remains at rest, as does the mallet shaft.

When the foot in pushed downwards, the output from the pedal potentiometer, 110, becomes greater than that from the mallet potentiometer, 113, and this gives rise to an output from the operational amplifier, 132, which thus drives the electric motor, 112. The gain of amplifier, 132, can be adjusted by means of potentiometer 133.

The electric motor 112, thus drives the mallet potentiometer, 113 (refer to the link between the motor and the potentiometer, which is indicated in the diagram by means of the dotted line) and, because the system has been arranged so that such rotation of mallet potentiometer, 113, increases the output from it, the mallet shaft will be rotated by the motor until the output from the mallet potentiometer is equal to that from the pedal potentiometer. When the two voltages are equal, the motor, and hence the mallet shaft, stop rotating.

When the foot is raised, the output from the pedal potentiometer, 110, becomes less than that from the mallet potentiometer, 113, and the net voltage, now being due to the greater value at the inverting input, A, of amplifier, 132, is thus inverted. The motor is thus rotated in a direction opposite to that previously experienced, and the mallet is therefore driven likewise.

The downward and upward movements of the foot pedal caused by the foot of the drummer thus create faithful replications of such movement at the mallet via the controlled rotation of the motor.

While the apparatus just described has involved the use of potentiometers connected outside the motor, the incorporation of a potentiometer in the motor framework or anyway as a functional part of the motor assembly, will reduce the effects of backlash and therefore improve response time and performance. It is, however, appreciated that such incorporation might make the system less flexible in terms of convenience of replacing a faulty potentiometer or in terms of the cost of a whole motor, if the potentiometer was not separable. It does, however, afford means for providing a compact unit for implementing the principles of the invention.

An alternative, which might be considered more flexible, would be to incorporate the mallet potentiometer in a specially designed mallet-holding-assembly which has the mallet-holding part rotating due to the drive from a motor while the wiper remains fixed and is supported in the pedestal assembly. This configuration thus, effectively, results in the movement of the wiper in relation to the mallet-holding-assembly.

One variant based on this assembly is thus envisaged as consisting of two main parts. One part consists of the mallet-shaft holder (with insertable and clampable mallet) whose shaft is held in a bearing in the left hand support pillar of the pedestal, and the other part, which can be fixed into a bearing assembly inside this, consists of the potentiometer, whose wiper is effectively "turned" when the mallet shaft is rotated because the outer casing of the potentiometer rotates with the mallet-shaft holder while the wiper part remains fixed to the right hand pedestal.

In order to provide for adjustment of the standby, and "bass drum head strike", position of the mallet, in the development system described above, balance potentiometers, 134, 135, and 136, 137, are included between the 10 Volt Reference Supply Rails and the supply terminals of potentiometers, 110 and 113, respectively.

Potentiometers, 134, 135, 136 and 137, can also be used to control the sensitivity of the system by allowing the value of the voltage supplied to the terminals of the pedal potentiometer, 110, and to the mallet potentiometer, 113, to be adjusted. Alternatively, these voltages can be independently adjusted.

Thus, for example, the voltage supplied to potentiometer, 113, could be reduced from 10 Volts to, say, 5 Volts, by adjustment of potentiometers, 136 and 137. In such case, the wiper of potentiometer, 113, then has to move through twice the angle (assuming a linear relationship between angle of rotation of the wiper and the "tapped off" voltage) that it would for a 10 Volt supply, in order to "match" any given movement of the pedal potentiometer, 110. Of course, if too little voltage in supplied to potentiometer, 113, the motor, 112, will keep attempting to balance the output of potentiometer, 110, by turning the wiper of potentiometer, 113, and will eventually "run out of voltage". The system will then go out of control.

The reverse of this would be to adjust potentiometers, 134 and 135, in order to reduce the value of the reference voltage supplied to pedal potentiometer, 110, to 5 volts. Mallet potentiometer, 113, would then have only to move through half the angle that it would move through when pedal potentiometer, 110, was supplied with 10 volts at its supply terminals, for any given rotation of potentiometer, 110.

A further option involving the supply of voltage to the mallet potentiometer, 113, in to arrange for the drive for the pedal-operating potentiometer, 110, to also drive another potentiometer, which itself supplies the terminal voltage for the mallet potentiometer, 113, but in such a way that this voltage reduces in value as the output from the pedal potentiometer, 110, increases. This method can be used to produce an accelerating effect if it is applied within carefully controlled limits and with particular consideration given to preventing the system from going out of control, as already mentioned above. The reverse of this arrangement will produce the opposite effect and could be used in evaluation procedures.

The use of potentiometers having linear, logarithmic, and other relationships provides for a range of alternative relationships between movement of the pedal and corresponding movement of the mallet.

In order to provide the torque required for driving the mallet, the motor, 112, is geared, and the gear ratio and power of motor used, depend on the dimensions of the driven mallet system. Since the rotary potentiometer, 113, is mounted directly onto the mallet shaft, its operating range is less than 360 degrees. Due to the gearing employed, the internal shaft of motor, 112, will turn through many revolutions for the execution of the full range of motion of the mallet shaft.

In practice, the system has worked satisfactorily with a rotary potentiometer having a range of 110 degrees and it is anticipated that definitive products will involve potentiometers having appropriate ranges, which may be quite narrow.

In order to prevent overrun of the driven part of the potentiometer, limit switches have been incorporated into the circuitry utilized in demonstration prototypes, so that the motor is disabled if desired limits of movement are exceeded.

It is pointed out, with reference to the foregoing, that while the new system can be applied to the conventional style of operation of the bass drum mallet, where the drum head is generally vertically orientated, the principles of the invention can be implemented in equipment which utilizes "drum pads" which can be played in any desired orientation and which are generally played with the "drum pad" in a horizontal orientation with the mallet striking the "pad" from a standby position which is different from that encountered with conventional bass drum systems.

It is further pointed out that the principles of the invention can be implemented for the operation of multiple mallet systems involving at least two mallets, by use of appropriately designed motor or other drive systems, based on the principles described in this specification.

It is still further pointed out, with reference to the foregoing, that the principles of radio and ultrasonic control can be applied to the operation of bass drum mallets as described with reference to the use of direct current motors using servo feedback principles.

With reference to the schematic diagram shown in FIG. 19, a specially designed 4 Quadrant linear direct current drive controller, 138, known as the 500XLV, used for controlling DC Motors, is shown. This is made by Sprint Electric Ltd, Rudford Industrial Estate, Ford, Arundel, West Sussex, BN18 0BE, England. Details are reproduced by kind permission of Sprint Electric Ltd.

This controller has been used successfully for implementing the principles of the invention already described with reference to FIGS. 16A and 16B, 17A, 17B, 17C, and 18, and the various labeled parts are assumed to have the same function as those parts described with reference to these Figures. It is pointed out that FIG. 19 does not provide any details of the internal circuitry.

The 500XLV controller is a small, fast response, linear DC motor, speed controller, which can drive brushed DC motors in both directions of rotation with + −torque. The unit operates from a dual polarity supply and has a wide supply range.

Speed regulation is by armature voltage feedback as standard, and customer adjustment to compensate for the IR drop is provided. IR drop is the voltage drop across the armature resistance of the driven motor. This method allows control without the use of a tachometer.

The unit has +10 Volt and +5 Volt precision references and positive and negative differential speed demand inputs.

The output stage has built-in thermal protection and current limit, and is provided with facilities to allow 3 term PID (Proportional, Integral and Derivative) control action. This may be used to implement speed control with tachometer feedback, or position control, e.g. linear actuators. It is also possible to add a speed demand ramping action if desired.

The thermal dissipation depends on the current and voltage supported by the unit and, as with all linear devices, this may be high under certain conditions. In the event of thermal power limiting, it may be necessary to increase the effective heatsink. The unit in designed for simple fixing to a metal surface or heatsink.

| | |
|---|---|
| Voltage Limit | For DC motors with maximum voltage ratings from + − 3 to + − 24V. |
| Current Limit | 0 to + − 5 Amps continuous, + − 7.5 Amps Peak. |
| DC Input Supply | + − 12 to + − 30V. |
| Presets | Maximum Speed Limit and IR Compensation 0 to 3 Ohms. |
| References | Precision current limit voltage references of +10V and +5V, at 5mA max; both short circuit Protected. |
| Speed Inputs | Differential Inputs. 300 Ohms input impedance. Will accept speed demand inputs of + − 5V or + − 10V. Input signal range up to + − 10V outside the supply. |
| Control Action | P (Proportional) or P + I (Proportional + Integral) or PID (Proportional + Integral + Derivative). |
| Protection | Thermal protection by automatic power limiting. Short circuit protected output. |

Terminal Meanings in FIG. 19:

1. +10V Reference
2. −SP inverting speed input
3. +SP non-inverting speed input
4. +5V Reference
5. COM. Common OV. (See also Terminal 9)
6. V−, −ve DC power supply input
7. V+, +ve DC power supply input
8. A+, Motor Armature connection
9. A−, Motor Armature connection; Also OV (See Common Terminal 5)

With the controller set up for use in the Position Feedback mode, it was found that best results were obtained with the unit in PID mode.

Details of the motors and other parts used for the practical implementation of the principles of the invention are given at the end of this specification.

With reference to FIG. 20, which represents a side elevation, a foot pedal assembly, 139, resembling the unit, 115, shown in FIGS. 17A, 17B and 17C, has the same basic components, already defined with reference to these Figures (which are therefore indicated but not referred to, individually, again) with the exception that there is shown, a chain, 140, passing over a sprocket, 141 (teeth shrouded from view) which has an accompanying restraining spring, 142, such that all three are mounted on a pedestal, 143. The upper end of spring, 142, is anchored to lever, 144, which is clamped to the shaft, 145, on which the sprocket, 141, is mounted.

The lower end of spring, 142, is adjustably mounted on the pedestal, 143, by means of a threaded stud, 146A (having threaded nut, 146B, connected to the spring) which passes into a threaded hole in an abutment, 147, on the pedestal, 143. A lock nut, 148, allows the setting of the spring tension to be fixed once it has been adjusted by alteration of the position of stud, 146A, which is provided with flats (not shown) for gripping with the fingers or a spanner.

Downwards movement of the foot of the drummer on the footplate, 116, thus causes the shaft, 122, of the linear potentiometer, 123, to move into the body of the potentiometer, 123, and extension of the chain, 140, causes the sprocket, 141, to rotate the lever, 144, against the restraining action of the spring, 142.

As an alternative to use of the linear potentiometer, 123, rotary potentiometer resembling potentiometer, 110, described with reference to FIGS. 16A and 16B, could be attached to shaft, 145, so that rotation of sprocket, 141, causes such potentiometer to rotate.

It is possible that, after experimenting with the new equipment, the drummer may well prefer to feel very little resistance to motion of the foot so that a more delicate system eventually evolves.

In one variant of the equipment, mere movement of the foot or of any other part of the body, could be used to move the mallet assembly, by arranging for the part of the body or an appendage to it, or a component part driven by the part of the body, to modulate or interfere with, by reflection or interruption, the reception, by appropriate interfacing circuitry, of electromagnetic radiation, either emanating from the part of the body itself (e.g. heat) or from any other source, where the part of the body or appendage to it, reflects, or interrupts, such beam. The equipment could be based on the principles of operation of motion detectors utilizing Passive Infra-Red (PIR) devices.

The appendage could be a reflective or illuminated strip placed on the foot, leg or thigh, or any other part of the body, and the position of the strip could be monitored by means of sensing equipment and associated circuitry which caused the movement of the strip to move the bass drum mallet according to the principles already described.

With reference to the perspective view shown in FIG. 21A, the motor-driven mallet assembly, 125A, referred to, with reference to FIGS. 17A, 17B and 17C, where it is shown only in outline in side elevation, is shown in more detail, in three dimensions.

The pedestal, 126, of the assembly, has left and right pillars, 149A and 149B, respectively, which are joined by means of a central section, 150, which itself has a clamp, 130, adjustable by means of a screw, 151, for mounting the pedestal on the rim of a bass drum.

The pedestal, 126, is provided with a shaft, 152, mounted in appropriate bearings (not shown) which carries a mallet assembly, 129, consisting of a mallet shaft, 36, and mallet, 35, comprising main part, 35A and felt tip, 35B.

The shaft, 152, extends through the right hand pillar, 149B, and through and beyond, the left hand pillar, 149A, where a section, 153, of the shaft, 152, formed so that it has a "D" shaped cross section, passes through a "D" shaped hole in the driven part, 154, of a rotary potentiometer, 128.

A coupling (not shown) connects the other end of the "D" shaped section 153, of the shaft, 152, with the output shaft, 155A, of a geared motor, 127. This is the motor referred to as item, 112, in FIGS. 16A, 18 and 19 and as item, 127, in FIG. 17A.

The body of motor, 127, is supported on its own pedestal (not shown) and the rotary potentiometer, 128, is clamped to the motor 127, and to the pedestal, 126, (no bolts shown) so that the whole assembly forms one rigid body clamped to the rim of the bass drum. It is to be noted that the motor, 127, and the rotary potentiometer, 128, are much closer to pedestal, 126, than as shown in FIG. 21A. Furthermore, the pedestal, 126, and that of the motor, 127, would be provided with anchoring bolts (not shown) so that the whole assembly could be anchored to the floor, if desired.

It is to be noted that, in a manufactured version of the assembly, 125A, shown in FIG. 21A, the rotary potentiometer, 128, could be placed between the mallet assembly, 129, and either the left hand, or the right hand, pillar, 149A or 149B, respectively, of the pedestal, 126. Alternatively, it could be placed on the right hand end of shaft, 152, outside the right hand pedestal, 149B. In either case, the rotary potentiometer, 128, would be bolted to one of the pillars, 149A, 149B.

Other variants could have both the motor, 127, and the rotary potentiometer, 128, fixed on either side of the mallet assembly, 129, respectively, between it and the appropriate pillar of the pedestal, 126. In such an assembly, the pillars would be separated from one another appropriately.

It is pointed out, with reference to the foregoing, that the drive from the motor, 127, to the mallet, 35, might need to involve having the motor shaft at right angles to, or anyway not in line with, the shaft, 152, holding the mallet assembly, 129. This would avoid complications which might arise from the proximity of the motor and the bass drum head 130B and /or the bass drum rim, 130A (see FIG. 17A). Such an arrangement is shown in FIG. 21B, which represents a perspective view.

With reference to FIG. 21B, a motor-driven mallet assembly, 125B, similar to that, 125A, already described with reference to FIG. 21A, has potentiometer, 128, mounted between mallet assembly, 129, and the left hand supporting pillar, 149A, of the pedestal, 126. Shaft, 155A, passes into the final output drive of a geared motor, 156 (or is otherwise coupled to its shaft) whose main motor shaft, 155B, is inclined at right angles with shaft, 155A. This arrangement allows the whole assembly to be mounted so that the motor does not limit positioning in relation to the bass drum itself.

The shaft, 155B, extending from the far end of the motor, 127, rotates at motor speed, while the shaft, 155A, rotates at reduced speed, dictated by the gear ratio. In practice, a motor speed of approximately 3000 revolutions per minute (rpm) with an output shaft speed of 93 rpm, was found to give satisfactory performance.

Further feedback control is possible by utilizing shaft, 155B. Thus, a voltage generating tachometer can be fitted to this shaft so that the output voltage can be compared with a preset value in the same way as has already been described for position control, with reference to FIGS. 16A and 16B and FIGS. 18 and 19.

Alternatively, a shaft encoder or a digital potentiometer, similar in operation to that, 40, already referred to with reference to FIG. 9, and providing digital output pulses, can be fitted to shaft, 155B. The use of these pulses together with intelligent processing circuitry, including digital counters, and in the ultimate refinement, microprocessing circuitry, can then be used to monitor the position of the motor shaft, 155B, and hence, through pre-calibration, the position of the mallet, 35.

The use of such monitoring methods therefore offers a range of alternative means for enhancing the implementation of the principles of the invention, so that the drummer has, at his disposal, a sophisticated system providing control of, and information about the position of, bass drum mallets.

An interesting adaptation of the equipment described with reference to FIGS. 21A and 21B, involves provision of means for manually rotating the body of potentiometer, 128, so that the consequent "out of balance" voltage then produced, causes the motor, 127, to rotate until balance is obtained. It can thus be readily seen that this adaptation gives rise to a new product which provides a power assisted bass-drum-pedal/mallet assembly, involving application of the foot directly to the bass-drum-pedal/mallet assembly, which is itself, directly attached to the bass drum, as in conventional pedal/mallet systems.

Furthermore, it can be seen that this also affords an alternative means for implementing pedal control via a rotary potentiometer in that, instead of rotating the shaft of a rotary position sensor, e.g. that of potentiometer, 110, referred to in FIGS. 16A and 16B, one could, instead, rotate the body of the potentiometer while the shaft was fixed.

Figures 22A, 22B:
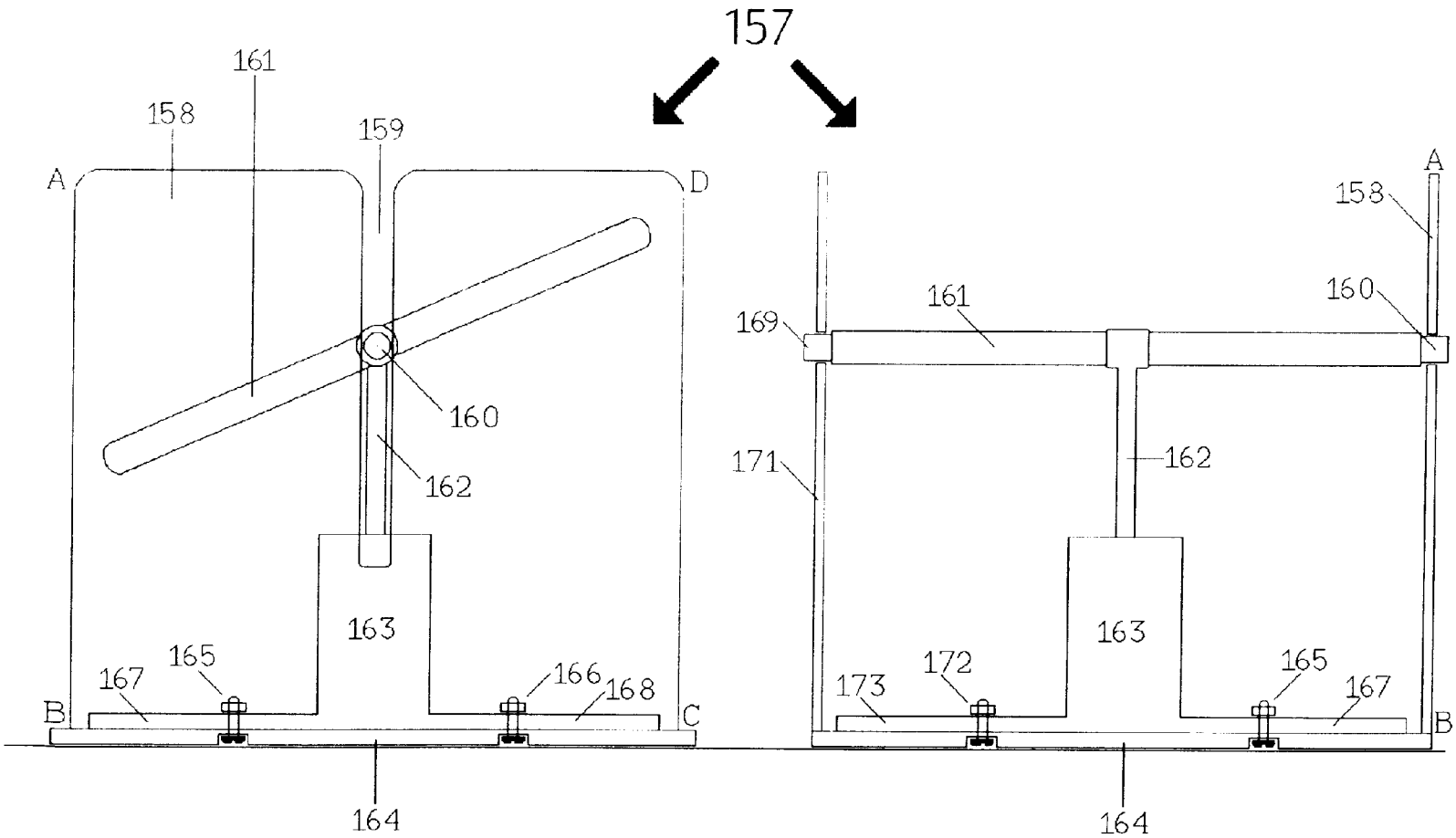
FIG. 22A shows a side elevation of a design of foot pedal assembly incorporating a swivellable footplate.
FIG. 22B shows a rear elevation of the foot pedal assembly shown in FIG. 22A.

With reference to FIGS. 22A and 22B, FIG. 22A shows a side elevation as viewed from the right hand side (left and right being defined for a view from the rear) and FIG. 22B shows a rear elevation, of a design of foot pedal assembly, 157, based on the concepts embodied in the foot pedal shown in FIG. 11A. A variant of the design shown in FIGS. 22A and 22B could incorporate the features of the double pedal shown in FIG. 11B.

For convenience in interpreting the diagrams, detail which would not be visible because of the opacity of the material used for the construction of the foot pedal assembly, are shown.

With reference to FIG. 22A, which represents a side elevation, the right hand wall, 158, defined by ABCD, of a foot pedal assembly, 157, has a slot, 159, within which the protruding, bearing part, 160, of a swivellable foot platform, 161, can be moved up and down by the foot. The center part of the platform, 161, is connected to the vertically orientated shaft, 162, of a linear potentiometer, 163, which is bolted to the floor, 184, of the foot pedal assembly, 157, by means of nut and bolt assemblies, 165 and 166, which pass through the left and right horizontal base areas, 167 and 168, respectively, of the base section of the potentiometer, 163. Locking means, not shown, allow the platform, 161, to be locked at any desired angle of inclination according to the requirements of the drummer.

With reference to FIG. 22B, the pedal assembly, 157, is shown as it would appear when viewed from the rear. The foot platform, 161, in shown in a horizontal orientation with the right hand bearing part, 160, extending through the slot, 159, (FIG. 22A) in the right hand wall, 158, and the left hand bearing part, 169, extending through the slot, 170 (not shown) in the left hand wall, 171, of the pedal assembly, 157. Bolt, 172, not visible in FIG. 22A, clamps another section of the base of the linear potentiometer, 163, to the floor, 164, of the pedal assembly, 157. The remaining bolt, XXX, of the four, is not shown but is shown in FIG. 23A.

Figures 23A, 23B:
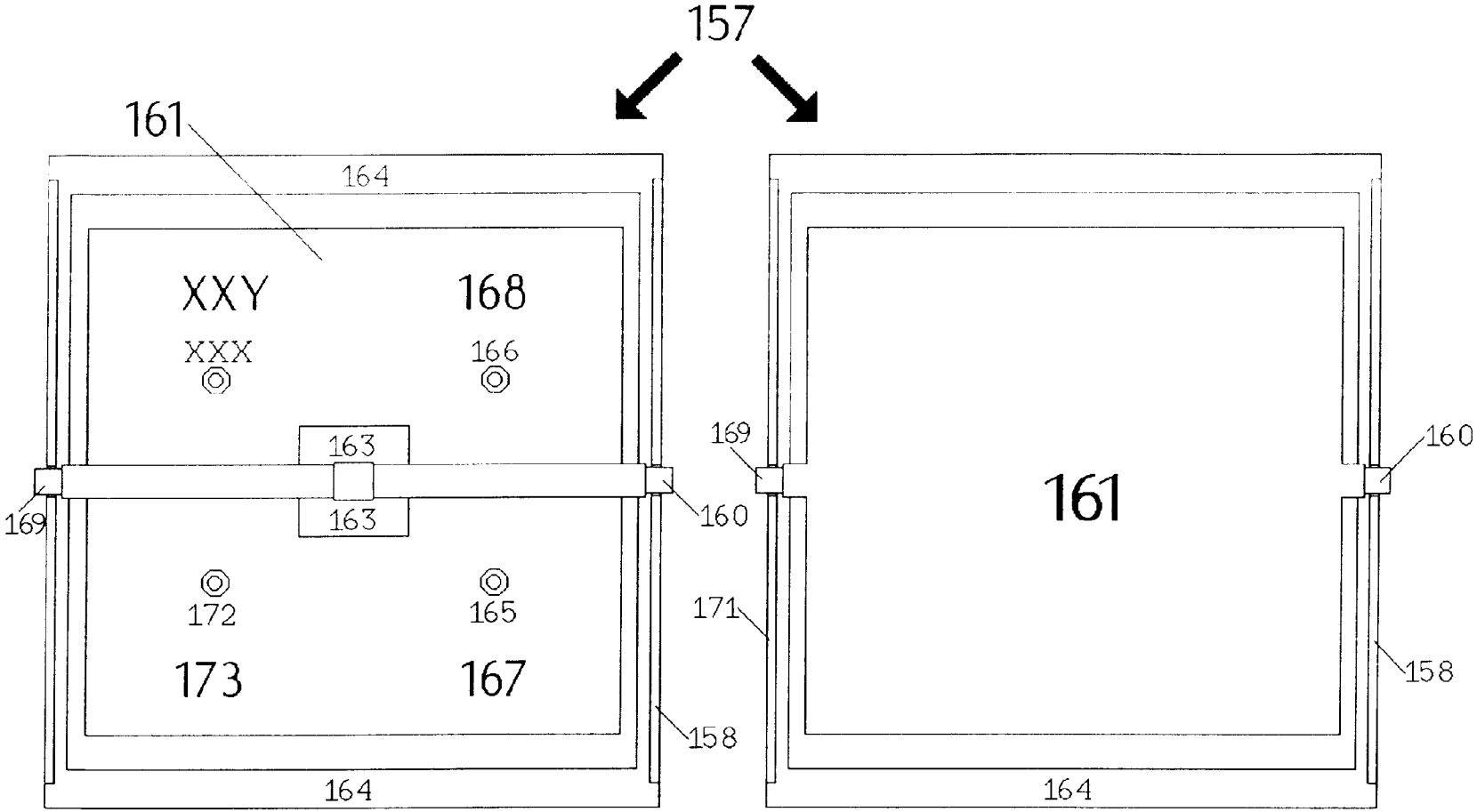
FIG. 23A shows a plan view of the foot pedal assembly shown in FIGS. 22A and 22B, with detail which would not actually be visible because of the opacity of part of the assembly
FIG. 23B shows a plan view of the foot pedal assembly shown in FIG. 23A, as it would actually appear.

With reference to FIG. 23A, which represents a plan view, the foot pedal assembly, 157, already described with reference to FIGS. 22A and 22B, is shown in plan view as though the footplate, 161, was transparent, so that those parts underneath the footplate, 161, can be seen. The various parts already described with reference to FIGS. 22A and 22B are self explanatory, with the exception of the nut and bolt assembly, XXX, and the region, XXY, of the base of the linear potentiometer, 163, which cannot be seen in FIGS. 22A and 22B.

It is to be noted that the term "linear" used in connection with potentiometers refers to the method of action, i.e. linear motion, rather than the relationship between movement of the wiper and the "tapped off" resistance, which could be a linear, logarithmic or any other relationship.

FIG. 23B in identical with FIG. 23A but is drawn so as to represent how the foot pedal assembly, 157, will appear when viewed directly from above and assumes that footplate, 161, is opaque.

With reference to FIGS. 24A to 24F, inclusive, which represent side elevations, FIGS. 24A and 24B are smaller representations of FIGS. 22A and 22B, respectively.

FIG. 24C is an alternative representation of FIG. 24A (in which latter Figure, the wall, 158, of the foot pedal assembly, 157, is assumed transparent) with the wall, 158, shown opaque.

FIG. 24D is identical with FIG. 24A but with the addition of a representation, 174, of the foot of the drummer and some "filling-in". FIG. 24E is identical with FIG. 24D with the exception that the footplate, 161, has been tilted forwards by the foot, 174, so that the plane of footplate, 161, is closer to the horizontal.

FIG. 24F resembles FIG. 24D with the exception that the body of linear potentiometer, 163X, is longer and that, there is a heel plate, 175, on which the heel of the drummer rests. The heel plate, 175, in connected by means of a swivel assembly to the shaft, 176, of an additional linear potentiometer, 178. In addition, the side walls, designated 158X, and the base plate, designated, 164X, extend rearwards to accommodate the potentiometer, 178.

This combination of potentiometers allows for considerable flexibility in bass drum operation, so that, through use of appropriate electronic circuitry, the following is possible:

1. Either the sole, or the heel, of the foot, can, via potentiometers, 163X or 178, respectively, be used to operate a bass drum mallet or mallets.
2. The sole of the foot can be used to operate one bass drum mallet while the heel is used to operate another bass drum mallet.
3. The sole can be used to implement the forward drive to the motor or any other electrically operated device driving the mallet assembly, and the heel can be used to provide the backward drive to the motor or to any other electrically operated device.

As an alternative to the above, the linear potentiometer, 163X, can be used in the way already described with reference to FIGS. 17A, 17B and 17C, while the other potentiometer, 178, is replaced by a switch which has the same outward appearance as potentiometer, 178, but which allows the drummer to use the heel plate, 175, to switch into action any device which the drummer way wish to bring into operation. Thus, for instance, he may wish to switch-in a programmed output to drive the bass drum that he in currently playing or bring into operation an additional bass drum or drums.

A variant of the above design could have two identical potentiometers, one below the front part and one below the rear part, of a foot platform having a central axle, so that the drummer can rock the foot backwards and forwards and by so doing, operate one bass drum mallet on the forward, downwards stroke, and another, on the backwards downwards stroke. These mallets can strike the same drum or different drums. In either case, the frequency of the beat can thus be doubled, accepting of course, that the drummer would then have to alter his style somewhat.

Figure 25B:
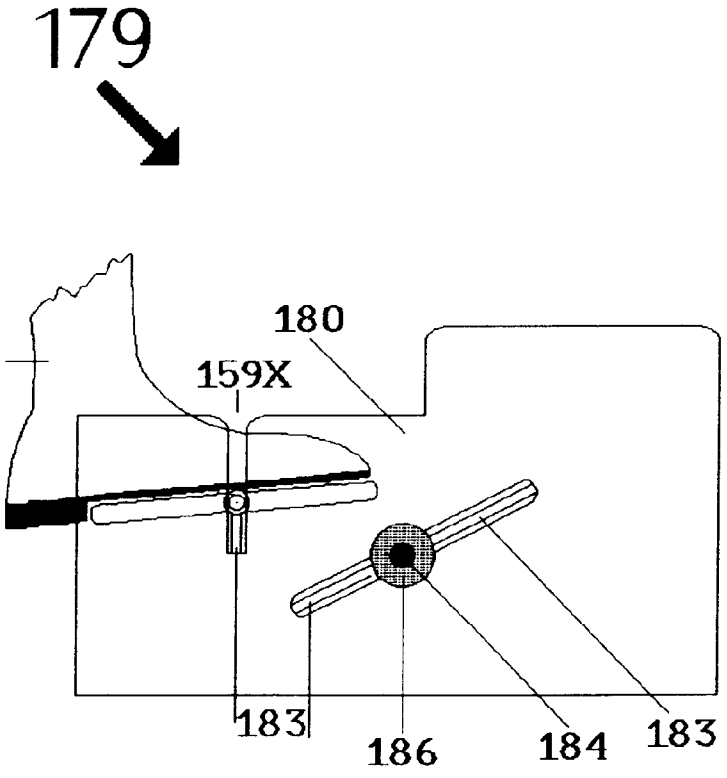
FIG. 25B shows, in side elevation an alternative representation of the foot pedal assembly shown in FIG. 25A.
Figure 25A:
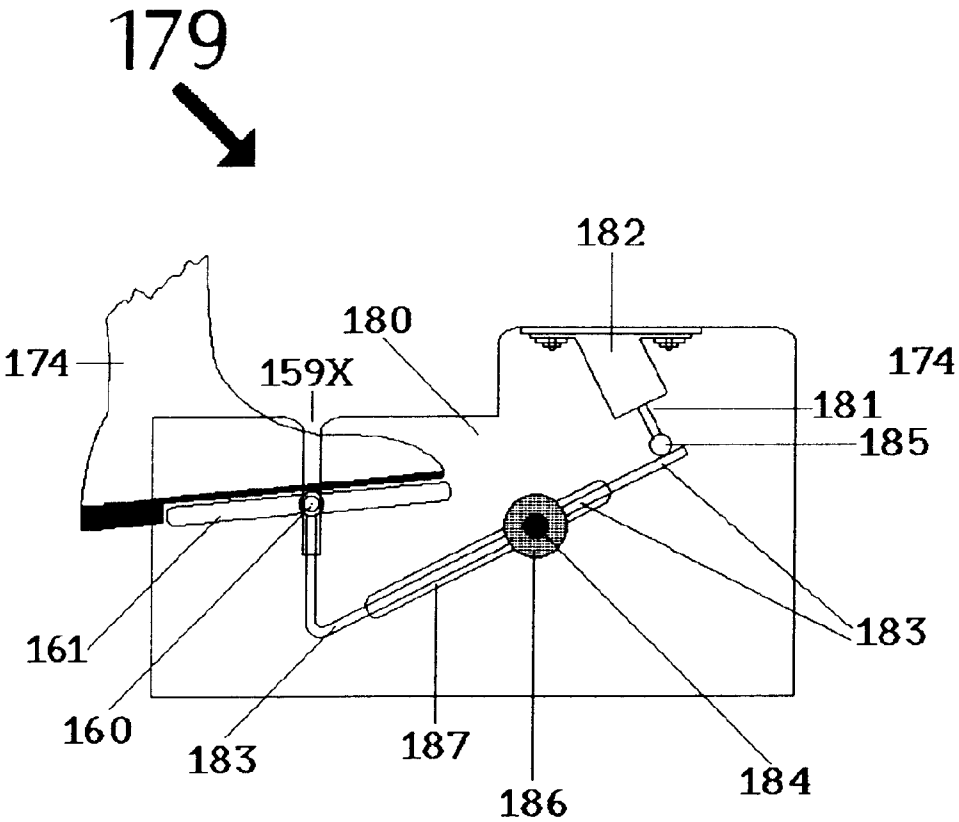
FIG. 25A shows an alternative design of foot pedal assembly containing embodiments of the invention.

With reference to FIG. 25A, which represents a side elevation, a foot pedal assembly 179, is shown with a foot, 174, resting on a footplate, 161, supported on a shaft, 160, both of which resemble those already described with reference to FIGS. 22A to 24F, inclusive.

The assembly, 179, has side walls, 180 (which are assumed transparent for this diagram) and a vertical slot, 159X, which acts as a guide for shaft, 160. The footplate, 161, operates the shaft, 181, of linear potentiometer, 182, via connecting rod, 183, which passes through a hole in a central shaft, 184, which itself acts as a pivot. The rod, 183, moves the shaft, 181, of potentiometer, 182, via contact between the end part of rod, 183, and a roller, 185 on the end of shaft, 181. Locking means, 186, lock the shaft, 184, against the side-wall, 180, of the assembly, 179. A similar arrangement is found on the other side of the foot pedal assembly and Shaft, 184, is able to rotate in a bearing assembly (not shown).

When unlocked, the shaft, 184, and shaft-locking means, 186, can be moved freely along the slot, 187, formed in the wall, 180, and in a similar slot on the other side of the assembly, so that the relative movements of footplate, 161, and the shaft, 181, of potentiometer, 182, can be altered. By these means, therefore, the sensitivity of the assembly to the movement of the foot of the drummer can be altered mechanically.

FIG. 25B, is identical with FIG. 25A, with the exception that the shaft, 184, has been slid along the rod, 183, towards the bend in the rod, 183, so that the foot, 174, now moves through a smaller distance for a given movement of the shaft, 181, of potentiometer, 182. FIG. 25B also shows only those details of the assembly which can actually be seen from the direction shown, since the walls, 180, are assumed opaque.

It is pointed out, with reference to FIGS. 24A to 24F, inclusive, and FIGS. 25A and 25B, and to any corresponding Figures, that mechanical stops can be incorporated into the design of the equipment in order to limit the movement of the footplate, 161 or any similar part, and of the heel plate, 175, so that no damage to other parts of the assembly can occur and also so as to provide the drummer with physical feedback about the position of the foot and heel.

Observations Concerning the Rate of Operation:

The maximum rate at which the "beater" of a conventional bass drum beats is approximately 180 beats per minute which is 3 beats per second.

If one beat was 90 degrees (deg.) forwards and 90 deg. backwards, then the beat cycle would be 180 deg. The maximum total angle to be traversed is therefore 3×180 deg. per second.

The oscillating Speed of the mallet shaft therefore has to be 180 deg. per ⅓ of a second or 90 deg. per ⅙ second for motion in one direction.

The rotational speed of the output shaft of motor, 112, used in the prototype, is approximately 90 rpm, which is 1.5 revolutions per second. Therefore, the shaft of the motor can execute 540 deg. in one second, which is equivalent to 90 deg. in ⅙ second. The motor can therefore meet the maximum requirements defined above.

However, whatever the ultimate requirements are, they can always be met with suitable electronic equipment and suitable motors or electrically driven equipment.

Since the motor also has to keep reversing its direction of rotation, the finite time for stopping and reversing direction has to be considered.

Looking at the situation from another point of view, the use of position feedback control to place the mallet in the position that it would move to, if operated by means of a conventional pedal arrangement, should allow the required position to be reached instantaneously. Therefore, the motor, 112, together with the intermediate equipment, needs to respond so rapidly, that the fastest movement of the foot of the drummer can result in reproduction of this movement as movement of the mallet shaft, at a rate which is at least as fast as that obtained by conventional means and therefore, as defined in the previous paragraph.

It is pointed out, with reference to the foregoing, that the principles behind the various alternative methods described with reference to the operation of bass drum mallets could be applied to the operation of any other drum or cymbal or percussion instrument or device, including a piano or a bell or other such device.

Some of the material contained in this patent specification has been taken from Data Sheets and Application Notes supplied by RS Components Ltd., and has been reproduced with kind permission from RS Components Ltd, P.O. Box 9, Corby, Northamptonshire, NN17 9RS, England. RS and the RS Logo, are registered trade marks of RS Components Ltd. Other descriptive material has been reproduced by kind permission of other organizations.

It is pointed out, with reference to the foregoing account, that the two types of motor system described for driving the mallet, can, in addition to the manually derived methods described herein, be driven from a programmable unit. The methods are:

1. Stepper motors driven from a supply of pulses.
2. Analogue motors driven from a continuous supply as part of a servo-system.
3. Any other electrically driven device.

The electrical output from so called "drum machines" which produce synthesized drum beat sounds in a variety of styles, or the output from an electronic or any other type of synthesizer, could be utilized, together with either of these three methods, for operating bass drum mallets or any devices working on similar principles.

This can be achieved by using appropriately designed circuitry to condition the output from the "drum machine", or synthesizer, etc., so that a varying voltage replaces the varying voltage produced by the foot pedal output i.e. that from the pulse generating digital potentiometer, 40, or that from the analogue "voltage tapping off" potentiometer, 110.

It is also pointed out that any "self running" equipment, whether based on the principles and description given in the foregoing or on any other principles, could be started and stopped by operation of circuitry which is activated by means of a switch which is, itself, operated by means of a drum stick held by the drummer. Such a switch could, for instance, be a "pad switch" which, by means of the circuitry, e.g. a set-reset, flip-flop (and power handling switch circuitry if required) would allow the drummer to either augment existing music or introduce bass drum and/or other equipment to take over for required periods, while he has a rest. He could also work along with other drummers and musicians any of whom could have access to the equipment described herein.

Other options can involve foot operated switches (e.g. item, 178, referred to with reference to FIG. 24F) or sound or light operated switches.

It is pointed out, with reference to the foregoing account, that the flexibility with which drumming equipment can be arranged and therefore played, can be further improved by utilizing motorized, or otherwise power assisted, methods, to move the equipment itself.

Thus, for instance, the spacial orientation of a tom-tom mounted on a bass drum could be adjusted remotely by means of potentiometers close to the drummer by mounting the tom-tom on motorized shafts connected to a suitable servo-controller circuit similar, in its principle of operation, to that already described. Application of this principle to all of the drumming equipment will allow the drummer to quickly set up his equipment to a preferred configuration and to quickly alter it to any other configuration.

The use of microprocessing techniques will allow specific configurations to be stored on e.g. computer disks and utilized accordingly.

It is further pointed out, with reference to the foregoing account, that the separation of the foot pedal from the driven mallet in the new equipment reduces or eliminates, the tendency for the foot to cause the conventional foot-pedal-mallet-operating assembly, to wonder, and so, the new equipment does not require such drastic means for floor mounting.

It is still further pointed out that any of the electronic means for implementing backwards and forwards movement of first objects, each of which is arranged to strike a second object, can be adapted so as to be purely mechanical or partly mechanical and partly electronic.

The following is a list of parts supplied by RS Components which are referred to and/or used in the practical implementation of the principles of the invention:

| Identifier | Description RS | Stock Number |
|---|---|---|
| 40 | Panel Mounting Digital Potentiometer; Referred to as a Panel Mounted Encoder; 256 Pulses per revolution. | 187–337 |
| Equivalent Function to that of 40 | Optical Shaft Encoder having an output of 500 pulses per revolution (ppr). Note that other Encoders are available with lower or greater ppr. | 341–597 |
| 48 (included in 103) | Low Power Schottky, Hex Schmitt Trigger (Inverting). | 307–547 |
| 49 (included in 103) | 7493 Binary, divide by 16, Counter. | 306–443 |
| 50 | 4-Phase Unipolar Stepper Motor Drive Board. | 332–098 |
| 51 | Standard 32 Way Din 41612 Socket. | 471–503 |
| 108A and 109B | Hybrid Stepper Motor. | 440–464 |
| 104 | 12–14V d.c., at 10A. | 253–743 |
| Referred to, within 104 | d.c.-d.c., Convertor (driven by 253–743). | 596–911 |
| 107 | Opto-Isolator. | 110–208 |
| 108A & 108B | Stepper Motor. | 440–464 |

Note that the mallet used with e.g. stepper motor 108A, is connected to the shaft of the stepper motor by means of a suitable coupling which is not shown in FIG. 15.

| | | |
|---|---|---|
| 121 | Linear Potentiometer 5k Ohms; Linear; Referred to as a Linear Position Sensor. | 317–780 |
| 128 | Rotary Potentiometer 5k Ohms; Linear; Referred to as a Rotary Position Sensor. | 319–310 |
| 132 | High Power Operational Amplifier LM12 CLK. | 648–595 |
| Reference Voltage Source referred to in FIG. 18 | Any Reference Voltage Integrated Circuit which satisfies the input requirements of item, 132 | |

Parts From Other Sources

| Identifier | Description | Supplier |
|---|---|---|
| 112 & 127 | Type 332, 12V d.c. 2 Amp, geared Motor; Final Drive Output; 93 rpm; Ratio 25 to 1 | Manufactured by Buhler Nuremberg, Germany. Supplied by Bancroft Hinchey Ltd, Unit 9, Ashwyn Business Center, Burgess Hill, Sussex, England. |
| 138 | 4 Quadrant Drive | Sprint Electric Ltd |
| 112 & 127 | Arundel, Sussex, England. | |
| Couplings | Various | HPC Gears Ltd |
| Gearbox | P45-20 | Storforth Lane Trading |
| Output Shaft | P45-DX | Estate, Chesterfield, S41 0QZ, England. |

It is further pointed out that the inventive features and information embodied in the foregoing description will lead to new musical genres.

What is claimed is:

1. An arrangement for enabling at least one first object selectively to strike, at least once, at least one second object in order to produce therefrom, a desired operational sonic response, the arrangement comprising: a first apparatus selectively operable by an interaction between a part of a user and said first apparatus wherein a first movement of the part of the user makes a first interaction with said first apparatus to develop a force causing movement of the at least one first object toward said at least one second object, and wherein a second movement of the same part of the user in a direction opposite the first movement makes a second interaction with said first apparatus to develop a force, in addition to any biasing force, causing movement of the at least one first object away from said at least one second object, and a programmable electronic unit, which generates electronic signals for driving said at least one first object in addition to said first and second movements of the first apparatus, the programmable electronic unit being pre-programmed to create a desired sequence of electronic drive pulses and which can be brought into, and out of, action, under the control of the user.

2. An arrangement as claimed in claim 1 wherein said first apparatus comprises indication means for generally sensory indicating a location of said at least one first object in relation to the location of said at least one second object and in relation to the location of the user, and a first adjustment means for adjusting the sensitivity of movement of said at least one driver which drive said at least one first object under influence of the user, and a second adjustment means for adjustment of generally reactive response of said at least one second object to impact of said at least one first object with said at least one second object.

3. An arrangement as claimed in claim 2, wherein the driver comprises a stepper motor and the arrangement further comprises a digital potentiometer interfaced to an electronic circuit coupled to the stepper motor to provide motion of said stepper motor.

4. An arrangement as claimed in claim 1 further comprising a speed control for controlling the speed of said at least one first object relative to said at least one second object.

5. An arrangement as claimed in claim 4 further comprising a tachometer feedback for providing a indication to said first apparatus of the speed of the at least one first object relative to said at least one second object.

6. An arrangement for enabling at least one first object selectively to strike, at least once, at least one second object in order to produce therefrom a desired operational sonic response, the arrangement comprising: a first apparatus selectively operable by an interaction between a part of a user and the first apparatus wherein the part of the user continuously interacts with said first apparatus, once interaction with said first apparatus has taken place and independent of any biasing force, at least one electromagnetic driver coupled to the first apparatus so that operation of the at least one first object involves movement of the first apparatus in any desired direction in space, the movements of the first apparatus continuously controlling the position of the at least one first object relative to said at least one second object, through the at least one electromagnetic driver, over a range of positions including at least one impact position producing said desired operational sonic response, a speed control coupled to the at least one electromagnetic driver for controlling the speed of said at least one first object relative to said at least one second object, and a tachometer feedback for providing a indication to said first apparatus of the speed of the at least one first object relative to said at least one second object.

7. An arrangement as claimed in claim 6 further comprising an electrical power supply supplying power for said force causing said at least one first object to move.

8. An arrangement as claimed in claim 7, wherein said at least one electromagnetic driver is coupled to the electrical power supply and is selected from the group consisting of a linear motor, a stepper motor, and a servo motor.

9. An arrangement as claimed in claim 8, wherein the at least one electromagnetic driver comprises a linear motor and said first apparatus further comprises a device that generates an electronic signal and is interfaced to an electronic circuit which drives the linear motor.

10. An arrangement as claimed in claim 8, wherein the at least one electromagnetic driver comprises a stepper motor and said first apparatus further comprises a an optical shaft encoder, which is interfaced to an electronic circuit which drives the stepper motor.

11. An arrangement as claimed in claim 10, wherein operational motion of said optical shaft encoder creates digital pulses utilizable to drive the stepper motor shaft carrying said at least one first object relative to said at least one second object in synchronization with the motion of the optical shaft encoder.

12. An arrangement as claimed in claim 8, wherein the at least one electromagnetic driver comprises a servo motor and said first apparatus further comprises a potentiometer, which is interfaced to an electronic circuit which drives the servo motor.

13. An arrangement as claimed in claim 12, wherein operational motion of said potentiometer creates a voltage in a servo-potentiometer circuit for driving said servo motor shaft carrying said at least one first object relative to said at least one second object and wherein an electronic circuit is utilized to drive the servo motor.

14. An arrangement as claimed in claim 8, wherein said first apparatus comprises, means for producing at least one beam of electromagnetic radiation, said part of the user interacting with the beam to produce signals for driving said electromagnetic driver.

15. An arrangement as claimed in claim 8, wherein said first apparatus comprises, means for receiving electromagnetic radiation, said part of the user providing a thermal source of electromagnetic radiation, which radiation is utilized to produce signals for driving said electromagnetic driver.

16. An arrangement as claimed in either of claims 1 or 4 further comprising a speed demand ramping control for controlling the acceleration of the at least one first object.

17. An arrangement as claimed in either of claims 1 or 4 wherein said speed control comprises a potentiometer selected from the group of potentiometers having linear, logarithmic, and other relationships providing for a range of alternative speed patterns for the at least one first object.

18. An arrangement as claimed in claim 1 further comprising a position range control for limiting said range of positions of the at least one first object.

* * * * *